US011034417B2

(12) United States Patent
Khachaturian

(10) Patent No.: US 11,034,417 B2
(45) **Date of Patent: *Jun. 15, 2021**

(54) FLOATING CATAMARAN PRODUCTION PLATFORM

(71) Applicant: VERSABAR, INC., Houston, TX (US)

(72) Inventor: Jon Khachaturian, New Orleans, LA (US)

(73) Assignee: VERSABAR, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/676,258

(22) Filed: Nov. 6, 2019

(65) Prior Publication Data

US 2020/0140043 A1 May 7, 2020

Related U.S. Application Data

(63) Continuation of application No. 15/786,158, filed on Oct. 17, 2017, now Pat. No. 10,486,779, which is a (Continued)

(51) Int. Cl.
*B63B 35/44* (2006.01)
*B63B 1/12* (2006.01)
(Continued)

(52) U.S. Cl.
CPC ..... *B63B 35/4413* (2013.01); *B63B 1/121* (2013.01); *B63B 1/14* (2013.01);
(Continued)

(58) Field of Classification Search
CPC ..... B63B 2035/448
See application file for complete search history.

(56) References Cited

U.S. PATENT DOCUMENTS 485,398 A 11/1892 Tyler et al.
541,794 A 6/1895 Schon
(Continued)

FOREIGN PATENT DOCUMENTS

BE 830370 12/1975
GB 2110602 6/1983
(Continued)

OTHER PUBLICATIONS

PCT International Search Report and the Written Opinion of the International Searching Authority, International Application No. PCT/US2016/057300; dated Feb. 26, 2017.

*Primary Examiner* — Andrew Polay
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A catamaran oil production apparatus is disclosed for producing oil in a marine environment. The apparatus includes first and second vessels that are spaced apart during use. A first frame spans between the vessels. A second frame spans between the vessels. The frames are spaced apart and connected to the vessels in a configuration that spaces the vessels apart. The first frame connects to the first vessel with a universal joint and to the second vessel with a hinged connection. The second frame connects to the second vessel with a universal joint and to the first vessel with a hinged or pinned connection. At least one of the frames supports an oil production platform. One or more risers or riser pipes extends from the seabed (e.g., at a wellhead) to the production platform (or platforms). In one embodiment, the production apparatus includes crew quarters.

18 Claims, 22 Drawing Sheets

Related U.S. Application Data continuation-in-part of application No. 15/295,116, filed on Oct. 17, 2016, now Pat. No. 10,279,872.

(60) Provisional application No. 62/409,683, filed on Oct. 18, 2016, provisional application No. 62/360,120, filed on Jul. 8, 2016, provisional application No. 62/264,685, filed on Dec. 8, 2015, provisional application No. 62/176,918, filed on Oct. 16, 2015.

(51) Int. Cl.

| | |
|---|---|
| ***B63H 25/04*** | (2006.01) |
| ***B63H 25/38*** | (2006.01) |
| ***B63B 1/14*** | (2006.01) |
| ***B63B 35/28*** | (2006.01) |
| ***B63B 79/15*** | (2020.01) |
| ***B63B 79/20*** | (2020.01) |
| ***B63B 79/40*** | (2020.01) |
| *B63B 29/02* | (2006.01) |
| *B63H 25/42* | (2006.01) |

(52) U.S. Cl.

CPC ..... *B63B 35/28* (2013.01); *B63B 79/15* (2020.01); *B63B 79/20* (2020.01); *B63B 79/40* (2020.01); *B63H 25/04* (2013.01); *B63H 25/382* (2013.01); *B63B 29/025* (2013.01); *B63B 2001/123* (2013.01); *B63B 2035/4486* (2013.01); *B63H 2025/425* (2013.01)

(56) References Cited

U.S. PATENT DOCUMENTS

| | | | |
|---|---|---|---|
| 1,659,647 | A | 2/1928 | Althouse |
| 2,525,955 | A | 10/1950 | Scott |
| 3,217,681 | A | 11/1965 | Thornton et al. |
| 3,323,478 | A | 6/1967 | Hunsucker |
| 3,461,828 | A | 8/1969 | Bielstein |
| 3,807,336 | A | 4/1974 | Briggs |
| 4,166,426 | A | 9/1979 | Lloyd, III |
| 4,385,583 | A | 5/1983 | Ayers |
| 4,714,382 | A | 12/1987 | Khachaturian |
| 5,054,415 | A | 10/1991 | Marshall |
| 5,479,869 | A | 1/1996 | Coudon et al. |
| 5,607,260 | A | 3/1997 | Khachaturian |
| 5,609,441 | A | 3/1997 | Khachaturian |
| 5,662,434 | A | 9/1997 | Khachaturian |
| 5,800,093 | A | 9/1998 | Khachaturian |
| 5,836,463 | A | 11/1998 | Khachaturian |
| 5,863,085 | A | 1/1999 | Khachaturian |
| 5,975,807 | A | 11/1999 | Khachaturian |
| 6,000,562 | A | 12/1999 | Khachaturian |
| 6,039,506 | A | 3/2000 | Khachaturian |
| 6,079,760 | A | 6/2000 | Khachaturian |
| 6,149,350 | A | 11/2000 | Khachaturian |
| 6,213,319 | B1 | 4/2001 | Khachaturian |
| 6,257,165 | B1 | 7/2001 | Danos, Jr. et al. |
| 6,296,288 | B1 | 10/2001 | Khachaturian |
| 6,318,931 | B1 | 11/2001 | Khachaturian |
| 6,364,574 | B1 | 4/2002 | Khachaturian |
| 6,367,399 | B1 | 4/2002 | Khachaturian |
| 6,412,649 | B1 | 7/2002 | Khachaturian |
| 6,425,710 | B1 | 7/2002 | Khachaturian |
| 7,527,006 | B2 | 5/2009 | Khachaturian |
| 7,845,296 | B1 | 12/2010 | Khachaturian |
| 7,886,676 | B2 | 2/2011 | Khachaturian |
| 8,061,289 | B2 | 11/2011 | Khachaturian |
| 8,240,264 | B2 | 8/2012 | Khachaturian |
| 8,683,872 | B1 | 4/2014 | Khachaturian et al. |
| 8,739,717 | B2 | 6/2014 | Ellnor |
| 8,960,114 | B2 | 2/2015 | Khachaturian |
| 8,985,040 | B2 | 3/2015 | Khachaturian |
| 9,003,988 | B2 | 4/2015 | Khachaturian |
| 9,527,560 | B2 | 12/2016 | Khachaturian |
| 9,950,774 | B2 | 4/2018 | Khachaturian |
| 10,173,758 | B2 | 1/2019 | Khachaturian |
| 10,279,872 | B2 * | 5/2019 | Khachaturian ..... B63B 35/44 |
| 10,486,779 | B2 * | 11/2019 | Khachaturian ..... B63B 1/121 |
| 2005/0159052 | A1 | 7/2005 | Borrett |
| 2006/0249066 | A1 | 11/2006 | Conti |
| 2007/0009329 | A1 | 1/2007 | Chouest |
| 2007/0056496 | A1 | 3/2007 | Hodgson |
| 2007/0231076 | A1 | 10/2007 | Khachaturian |
| 2009/0301372 | A1 | 12/2009 | Khachaturian |
| 2010/0263581 | A1 | 10/2010 | Khachaturian |
| 2011/0197799 | A1 | 8/2011 | Khachaturian |
| 2013/0213288 | A1 | 8/2013 | Hall |
| 2015/0013586 | A1 | 1/2015 | Sancoff |
| 2015/0291267 | A1 | 10/2015 | Khachaturian |

FOREIGN PATENT DOCUMENTS

| | | |
|---|---|---|
| KR | 10-2010-0008652 | 1/2010 |
| WO | WO99/13164 | 3/1999 |
| WO | 03057556 | 7/2003 |
| WO | 2011129822 | 10/2011 |

* cited by examiner

FLOATING CATAMARAN PRODUCTION PLATFORM

CROSS-REFERENCE TO RELATED APPLICATIONS

This is a continuation of U.S. patent application Ser. No. 15/786,158, filed 17 Oct. 2017 (issued as U.S. Pat. No. 10,486,779 on 26 Nov. 2019), which is a continuation in part of U.S. patent application Ser. No. 15/295,116, filed 17 Oct. 2016 (issued as U.S. Pat. No. 10,279,872 on 7 May 2019), which claims benefit of U.S. Provisional Patent Application Ser. No. 62/176,918, filed 16 Oct. 2015; U.S. Provisional Patent Application Ser. No. 62/264,685, filed 8 Dec. 2015; and U.S. Provisional Patent Application Ser. No. 62/360,120, filed 8 Jul. 2016, each of which is hereby incorporated herein by reference and priority of/to each of which is hereby claimed.

U.S. patent application Ser. No. 15/786,158, filed 17 Oct. 2017 (issued as U.S. Pat. No. 10,486,779 on 26 Nov. 2019) claims benefit of U.S. Provisional Patent Application Ser. No. 62/409,683, filed 18 Oct. 2016, which is hereby incorporated herein by reference and priority of/to which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a catamaran marine oil drilling production platform apparatus or system. More particularly, the present invention relates to an improved catamaran oil production apparatus or system that employs spaced apart or catamaran hulls, each of the hulls supporting a truss or frame that spans between the hulls at spaced apart positions wherein one or both of the frames supports an oil drilling or production platform and risers that connect between the seabed and one or both platforms. Even more particularly, the present invention relates to an improved oil production platform apparatus or system for use in a marine environment, wherein spaced apart frames are connected to vessels or hulls in a configuration that spaces the hulls or vessels apart. In one embodiment, the first frame is connected to a first of the hulls with the universal joint and to the second hull with a hinged connection, the second frame connecting to the second hull with a universal joint and to the first hull with a hinged connection. In another embodiment, an oil production facility is supported upon one of the frames, or separate production facilities are supported on different frames. In an alternate embodiment, two gantry structures are supported on two barges or hulls. Each gantry structure provides a large deck area to support production equipment or accommodations to hang risers. The gantries can be supported upon the barges using alternating pivotal and universal joint connections. The system can be moored on location. One or both of the hulls can be used to store oil that flows to the hull or hulls via the risers. In another embodiment, the barges and gantries are connected using roll releases only at the hinged connections, providing for no relative motion between the gantries. This alternate embodiment allows for any number of gantries to be connected to the barge.

2. General Background of the Invention

In general, devices that employ a pair of spaced apart hulls have been patented. Additionally, many marine lifting patents have been issued to Applicant. These and other possibly relevant patents are contained in the following table, the order of listing being of no significance, each of which is hereby incorporated herein by reference.

TABLE 1

| PATENT NO. | TITLE | ISSUE DATE MM-DD-YYYY |
|---|---|---|
| 485,398 | Apparatus for Raising Sunken Vessels | 11-01-1892 |
| 541,794 | Apparatus for Raising Sunken Vessels | 06-25-1895 |
| 1,659,647 | Sea Crane | 02-21-1928 |
| 4,714,382 | Method and Apparatus for the Offshore Installation of Multi-Ton Prefabricated Deck Packages on Partially Submerged Offshore Jacket Foundations | 12-22-1987 |
| 5,607,260 | Method and Apparatus for the Offshore Installation of Multi-Ton Prefabricated Deck Packages on Partially Submerged Offshore Jacket Foundations | 03-04-1997 |
| 5,609,441 | Method and Apparatus for the Offshore Installation of Multi-Ton Prefabricated Deck Packages on Partially Submerged Offshore Jacket Foundations | 03-11-1997 |
| 5,662,434 | Method and Apparatus for the Offshore Installation of Multi-Ton Prefabricated Deck Packages on Partially Submerged Offshore Jacket Foundations | 09-02-1997 |
| 5,800,093 | Method and Apparatus for the Offshore Installation of Multi-Ton Packages Such as Deck Packages, Jackets, and Sunken Vessels | 09-01-1998 |
| 5,975,807 | Method and Apparatus for the Offshore Installation of Multi-Ton Packages Such as Deck Packages and Jackets | 11-02-1999 |
| 6,039,506 | Method and Apparatus for the Offshore Installation of Multi-Ton Packages Such as Deck Packages and Jackets | 03-21-2000 |
| 6,149,350 | Method and Apparatus for the Offshore Installation of Multi-Ton Packages Such as Deck Packages and Jackets | 11-21-2000 |
| 6,318,931 | Method and Apparatus for the Offshore Installation of | 11-20-2001 |

TABLE 1-continued

| PATENT NO. | TITLE | ISSUE DATE MM-DD-YYYY |
|---|---|---|
| | Multi-Ton Packages Such as Deck Packages and Jackets | |
| 6,364,574 | Method and Apparatus for the Offshore Installation of Multi-Ton Packages Such as Deck Packages and Jackets | 04-02-2002 |
| 7,527,006 | Marine Lifting Apparatus | 05-05-2009 |
| 7,845,296 | Marine Lifting Apparatus | 12-07-2010 |
| 7,886,676 | Marine Lifting Apparatus | 02-15-2011 |
| 8,061,289 | Marine Lifting Apparatus | 11-22-2011 |
| 8,240,264 | Marine Lifting Apparatus | 08-14-2012 |
| 8,683,872 | Test Weight | 04-01-2014 |
| 8,960,114 | Marine Lifting Apparatus | 02-24-2015 |
| 8,985,040 | Marine Lifting Apparatus | 03-24-2015 |
| 9,003,988 | Marine Lifting Apparatus | 04-14-2015 |

The following are hereby incorporated herein by reference: U.S. patent application Ser. No. 14/686,389, filed 14 Apr. 2015 (published as US Patent Application Publication No. 2015/0291267 on 15 Oct. 2015), which is a continuation of U.S. patent application Ser. No. 13/641,020, filed 22 Feb. 2013 (issued as U.S. Pat. No. 9,003,988 on 14 Apr. 2015), which is a 35 U.S.C. 371 national stage entry application of International Patent Application Serial No. PCT/US2010/031037, filed 14 April 2010 (published as International Publication No. WO 2011/129822 on 20 Oct. 2011), which is a continuation-in-part of U.S. patent application Ser. No. 12/337,305, filed 17 Dec. 2008 (issued as U.S. Pat. No. 7,886,676 on 15 Feb. 2011), which application claimed priority of U.S. Provisional Patent Application Ser. No. 61/014,291, filed 17 Dec. 2007, each of which is hereby incorporated herein by reference.

Also incorporated herein by reference are the following: U.S. patent application Ser. No. 13/584,415, filed on 13 Aug. 2012; U.S. patent application Ser. No. 13/028,011, filed on 15 Feb. 2011 (published as US Patent Application Publication No. 2011/0197799 on 18 Aug. 2011 and issued as U.S. Pat. No. 8,240,264 on 14 Aug. 2012); and U.S. patent application Ser. No. 12/760,026, filed 14 Apr. 2010 (Published as US Patent Application Publication No. 2010/0263581 on 21 Oct. 2010).

Also incorporated herein by reference are the following: U.S. patent application Ser. No. 15/295,116, filed 17 Oct. 2016; International Patent Application Serial No. PCT/US2016/057300, filed 17 Oct. 2016; International Patent Application Serial No. PCT/US16/57421, filed 17 Oct. 2016; U.S. Provisional Patent Application Ser. No. 62/176,918, filed 16 Oct. 2015; U.S. Provisional Patent Application Ser. No. 62/264,685, filed 8 Dec. 2015; and U.S. Provisional Patent Application Ser. No. 62/360,120, filed 8 Jul. 2016, each of which is hereby incorporated herein by reference.

BRIEF SUMMARY OF THE INVENTION

The present invention provides an improved catamaran oil production and/or oil drilling apparatus that employs first and second spaced apart vessels or hulls. The vessels can be barges, dynamically positioned marine vessels, other floating hulls or the like.

A first frame, gantry structure, or truss spans between the hulls at a first position. A second frame, gantry structure, or truss spans between the hulls at a second position. The first and second positions are spaced apart so that each frame can move independently of the other frame, notwithstanding wave action acting upon the hulls. The gantry structures provide large working space to support oil and gas production, quartering, gas compression as well as re-injection and water injection.

The first of the frames or trusses can connect to the first hull with a universal joint and to the second hull with a hinged connection. The second frame can connect to the second hull with a universal joint and to the first hull with a hinged connection. The catamaran hull arrangement can provide longitudinal flexibility in a quartering sea state due to the unique universal joint and hinge placement between the frames or trusses and the hulls or barges.

In one embodiment, one of the frames extends upwardly in a generally inverted u-shape that provides space under the frame and in between the hulls for enabling a marine vessel to be positioned in between the hulls and under the frames. The space in between the hulls and under the frames can also be used as clearance for elevating an object to be salvaged from the seabed to a position next to or above the water's surface. In a plan view, each frame can be generally triangular in shape. The frames can each be a truss or of a truss configuration.

In another embodiment, dynamically positioned vessels are controlled from a single computer, single locale or by a single bridge or pilot. This specially configured arrangement enables the use of two class one (1) dynamically positioned vessels to be used to form a new vessel which is classified as a class two (2) dynamically positioned (DP) vessel. The method and apparatus of the present invention allows for the structural coupling of two existing vessels (ships, supply boats etc.). The vessels provide a structural foundation for the gantry system for lifting operations as well as personnel housing, propulsion for combined system travel and position keeping through the use of dynamic positioning.

Through the integration of two vessels with existing propulsion and dynamic positioning systems to form a single vessel/system, the performance of the propulsion and dynamic positioning systems for the integrated vessel/system is superior. This arrangement provides vessels of one class of DP system such as DP class 1. However, with the method and apparatus of the present invention, a new vessel will have a DP system of a higher class such as DP 2 as a result of being combined/integrated together to form a single system. The performance of the propulsion system for the combined system of the present invention will also be superior when compared to the performance of the individual vessels. Superior in this regard means that the combined system will have multiple independent engine rooms and fuel supplies which provides greater propulsion redundancy. The loss of a main engine room due to flood or fire, or the contamination of an engine room fuel supply on one of the vessels will no longer result in the loss of propulsion for the combined system.

Similarly, steerage for the combined system can still be achieved given the loss of steerage (rudder or equivalent system) on one of the individual vessels.

All of the above make the performance of the combined system superior to the performance of the existing individual systems without fundamental change or modification to the individual vessels, i.e. it is the combining of the vessels through the use of gantries which are enabled by the Bottom Feeder technology which leads to the performance improvements.

The "quality" of a dynamic positioning system can be measured via robustness of the system and capability. Robustness of the system is a measure of how many components within the DP system can fail and the DP system remain able to maintain station keeping capabilities. The international standard for this is to assign a rating or classification to the DP system. There are three DP ratings: Class 1, Class 2 and Class 3. Higher or other classes of DP vessels can have greater degrees of design redundancy and component protection. Through the integration of two lower class vessels, higher levels of component and system redundancy automatically result. The ability of the system to maintain a selected station within a given set of wind, wave and current conditions is generally referred to as "capability". The higher the capability, the worse sea conditions can be tolerated and stay on location. Capability is in turn a function of thruster horsepower (or equivalent), numbers of thrusters and disposition (location) of thrusters around the vessel which will influence a thruster's ability to provide restoring force capability. Through the integration of two vessels of a given capability, increased capabilities will result since (a) there are now more thrusters in the combined system, and (b) the thrusters have a much better spatial distribution which means that the thrusters can provide a greater restoring capability. Further, the capability of the DP system will be superior even given the loss of system component(s) for these same reasons. Damaged system capability is also another recognized measure of DP system quality.

The present invention includes a method of lifting a package in a marine environment, comprising the steps of providing first and second vessels, spanning a first frame between the vessels, spanning a second frame between the vessels, spacing the frames apart and connecting the frames to the vessels in a configuration that spaces the vessels apart, connecting the first frame to the first vessel with a universal joint and to the second vessel with a hinged connection, connecting the second frame to the second vessel with a universal joint, and to the first vessel with a hinged connection, and supporting personnel housing on a said frame.

In one embodiment, one or both vessels is preferably dynamically positioned.

In one embodiment, the dynamic positioning functions of each vessel can be controlled from a single pilot house.

In one embodiment, the first frame is preferably a truss.

In one embodiment, the second frame is preferably a truss.

In one embodiment, further comprising the step of controlling the position of each vessel preferably with an electronic positioning device.

In one embodiment, further comprising the step of controlling the position of each vessel preferably with a computer.

In one embodiment, wherein the hinged connection preferably includes multiple pinned connections.

In one embodiment, further comprising the step of extending the first frame preferably much wider at one end portion than at its other end portion.

In one embodiment, further comprising the step of extending the second frame preferably much wider at one end portion than at its other end portion.

In one embodiment, a single computer preferably controls the functions of both vessels.

In one embodiment, the dynamic positioning functions of each vessel are preferably controlled by a single pilot.

In one embodiment, the dynamic positioning functions of at least one vessel preferably include thruster functions, steering functions and propulsion functions.

In one embodiment, the dynamic positioning functions of both vessels preferably include thruster functions, steering functions and propulsion functions.

In one embodiment, each boat is preferably a work boat having a bow portion with a pilot house, preferably a deck portion behind the pilot house, a load spreader platform preferably attached to the deck portion and wherein the first and second frames are preferably mounted on the load spreader platform.

In one embodiment, each boat is preferably a work boat having a bow portion with a pilot house, preferably a deck portion behind the pilot house, one or more load spreader platforms preferably attached to the deck portion and wherein the first and second frames are preferably mounted on the one or more load spreader platforms.

In another embodiment, a catamaran oil production apparatus can be used in a marine environment and wherein one or both frames supports a production platform though not supported simultaneously by both frames or trusses. The apparatus can employ two spaced apart barges or hulls or vessels.

The gantry structures provide a large working space to support oil and gas production, quartering, gas compression and re-injection and water injection.

One or more production risers can be provided that each run from subsea wells to the surface, suspended from one or both gantries or from one or both hulls.

One or more gas injection risers can be provided that each run from the surface, suspended from one or both gantries or from one or both hulls to subsea gas injection wells.

One or more water injection risers can be provided that each run from the surface suspended from one or both gantries or from one or both hulls to subsea water injection wells.

Two supporting hulls can be based in existing barges or support vessels or new custom built barges or support vessels.

The system of the present invention can be positioned on a station by either spread mooring, taut leg mooring or dynamic positioning.

The supporting hulls or vessels can provide oil and condensate storage. The produced oil and condensate can be stored in an attending floating storage and offloading tanker via a flexible hose connection. The system can leave the construction facility fully completed and commissioned.

In another embodiment, the barges and gantries are connected using roll releases only at the hinged connections, providing for no relative motion between the gantries. This alternate embodiment allows for any number of gantries to be connected to the barge.

In one embodiment, each of the frames preferably provides a space under the frame and in between the barges that preferably enables a package to be lifted and/or a marine vessel to be positioned in between the barges and under the frames. In this fashion, an object that has been salvaged from the seabed can preferably be placed upon the marine vessel that is positioned in between the barges and under the frames.

In one embodiment, one or more slings can be provided that preferably connect between a frame and a hull. The connection of each frame to a hull opposite the universal joint can be preferably a pinned or a hinged connection.

The system of the present invention can be mooring using a spread mooring system or dynamic positioning (DP). The spread mooring can be achieved using a wide range in number of mooring lines (e.g., from 4 to 16 individual lines). The mooring lines can be constructed from all steel wire, all steel chain, a combination of steel wire and steel chain, a combination of steel wire and clump weights, a combination of steel wire, steel chain and clump weights, a combination of steel wire and fiber rope, or a combination of steel chain and fiber rope.

Each gantry can have two wide sides (i.e., no pin-to-pin in either gantry), which locks the gantries rigidly to the barges in pitch motions but prevents any relative motions between the gantries. This arrangement allows for piping to be easily run between two gantries. In this embodiment there can be more than two (2) gantries.

In the case where there is a combination of pinned connection universal joints, there is relative motion between the gantries. In such a case, flexible high pressure hoses can be preferably used to connect oil and gas production and compression equipment located on the two gantries.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
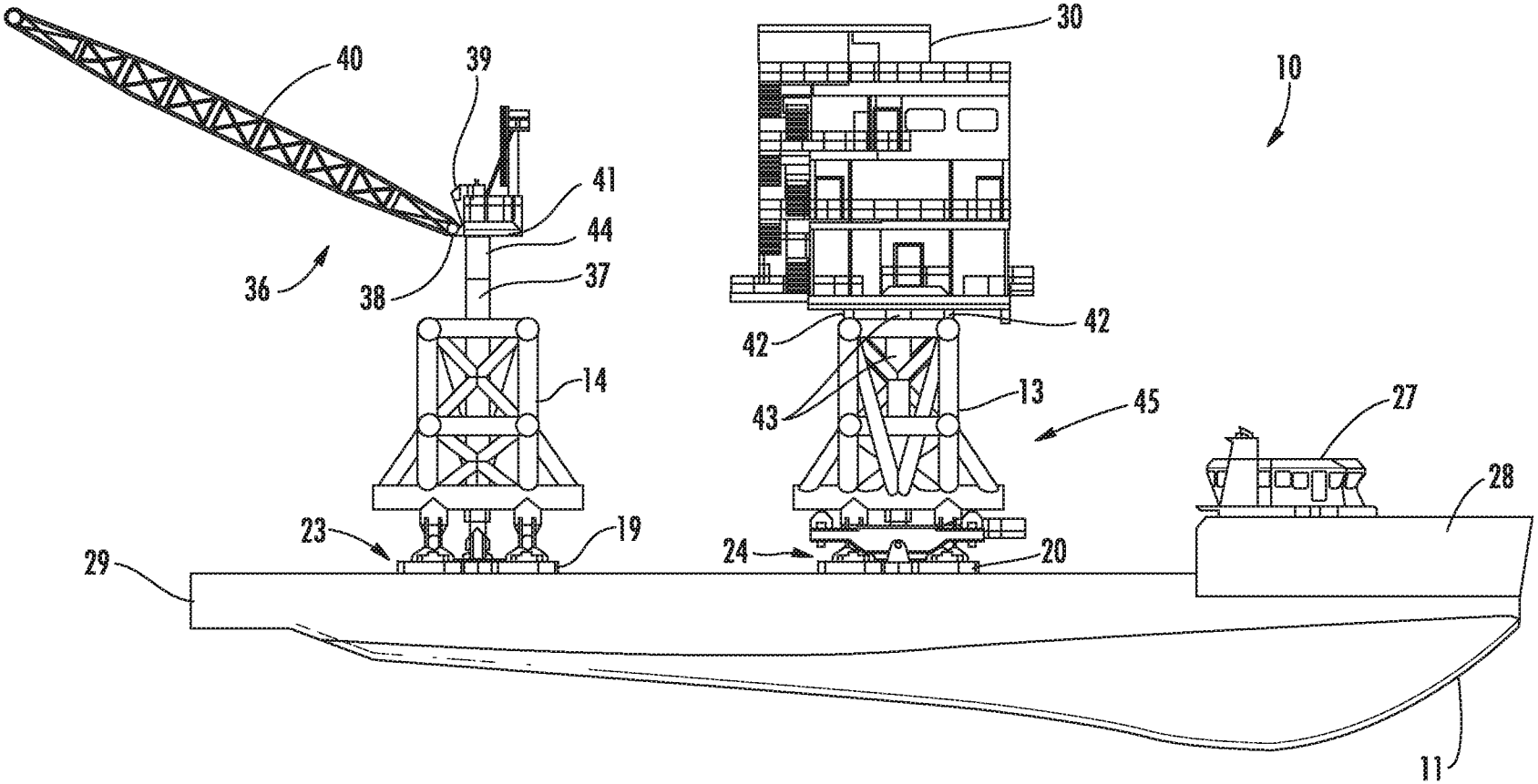
FIG. 1 is an elevation view of a preferred embodiment of the apparatus of the present invention.
Figure 2:
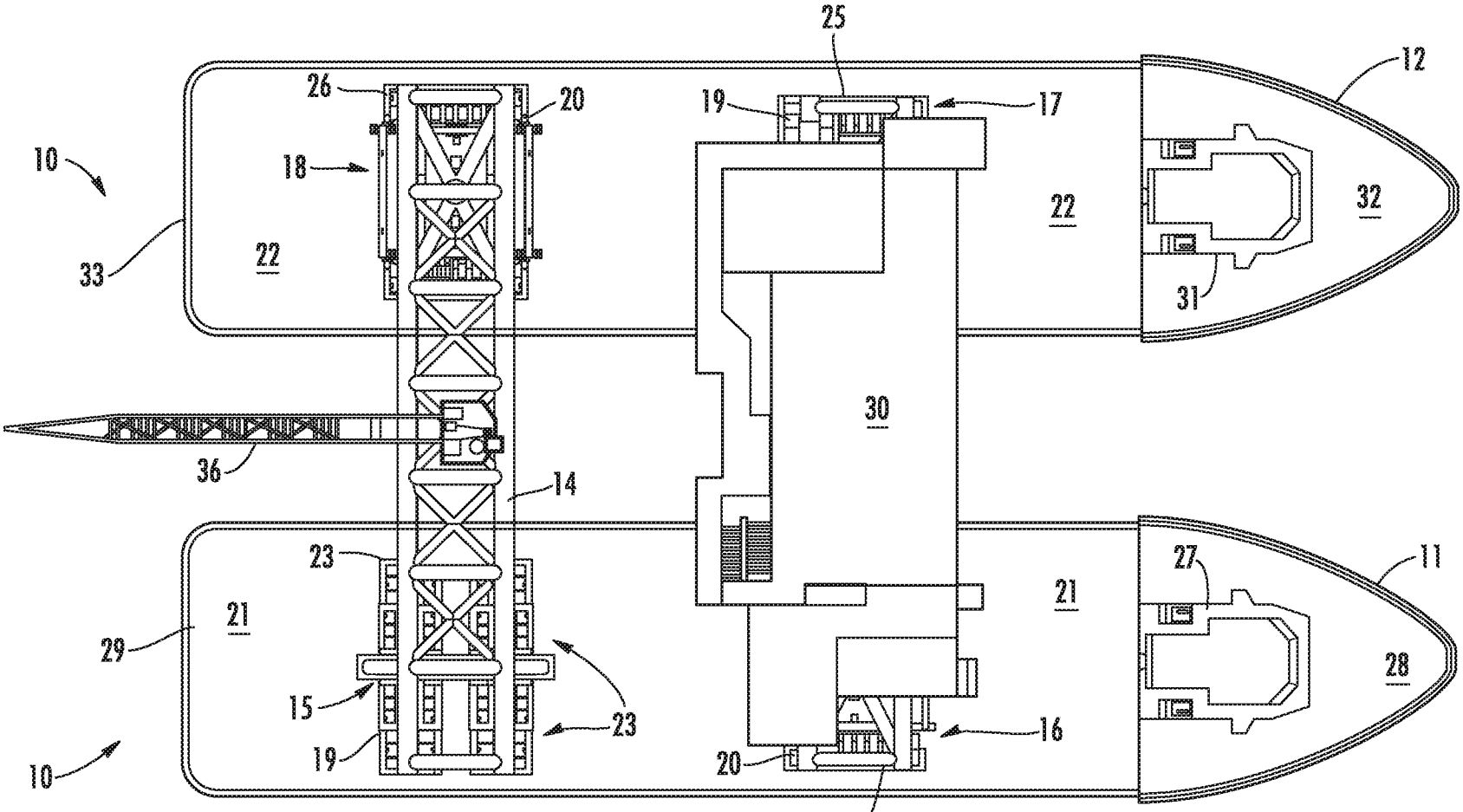
FIG. 2 is a plan view of a preferred embodiment of the apparatus of the present invention.
Figure 3:
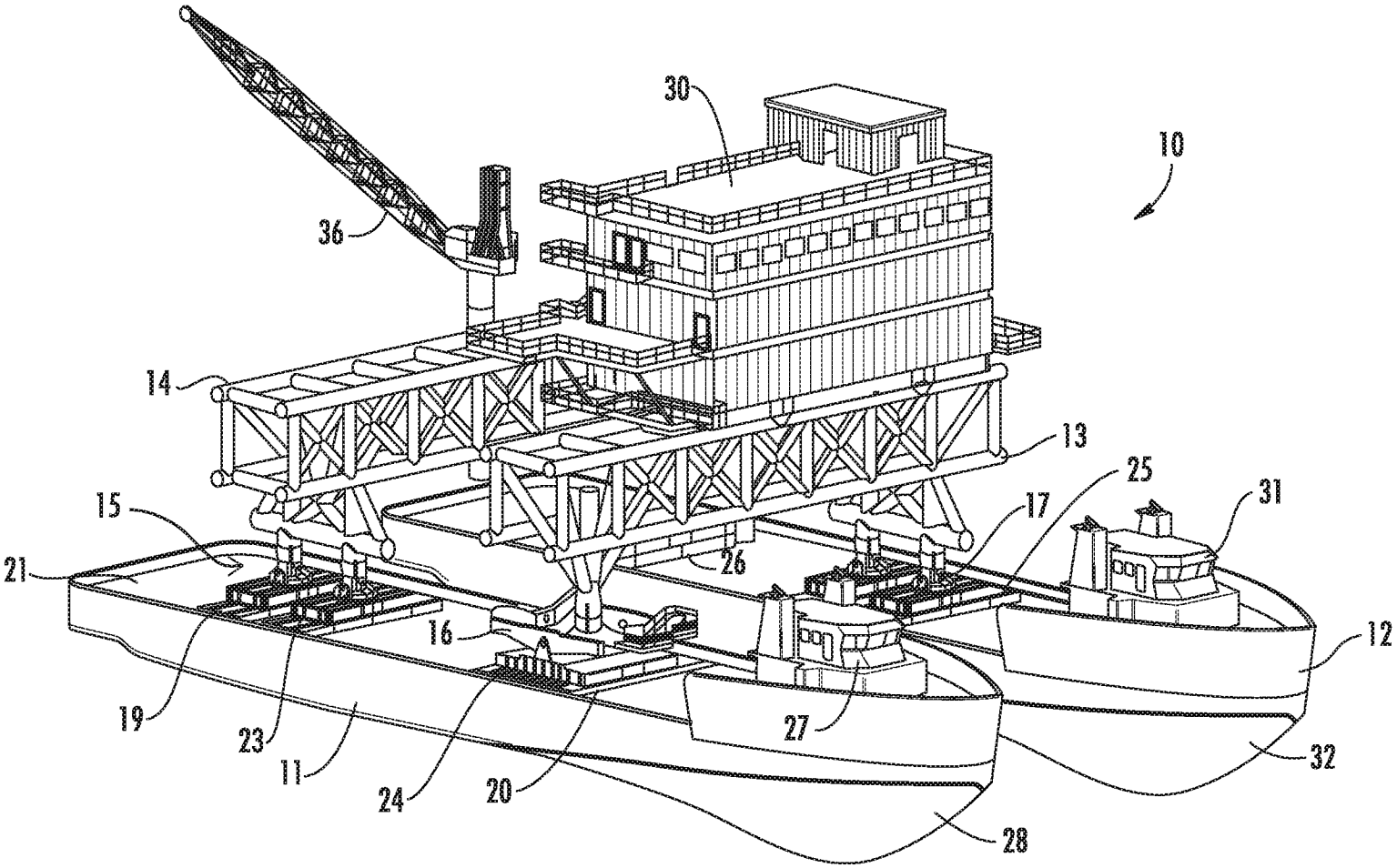
FIG. 3 is a perspective view of a preferred embodiment of the apparatus of the present invention.

FIGS. 1-8 show preferred embodiments of the apparatus of the present invention designated generally by the numeral 10. Marine drilling or production platform 10 provides a pair of spaced apart vessels or hulls 11, 12. Hulls 11, 12 can be barges, dynamically positioned vessels, or any other buoyant structures. A pair of frames 13, 14 are provided, each frame 13, 14 preferably spanning between the vessels 11, 12. Each frame 13, 14 preferably connects to one vessel 11 or 12 with a universal joint (and not a hinge) and to the other hull 11 or 12 with a hinged or pinned connection. In FIGS. 2 and 3, hull or vessel 11 connects to forward frame 13 with universal joint connection 16. Hull or vessel 11 connects to aft frame 14 with hinge or pivotal connection 15. Vessel or hull 12 connects to forward frame 13 with hinge or pivotal connection 17. Vessel or hull 12 connects to aft frame 14 with universal joint connection 18.

In addition to the connections 15, 16, 17, 18, an interface, such as a deck beam or beams, can be provided on the upper deck 21, 22 of each hull 11, 12. The interface can be a load spreader platform between the frames 13, 14 and the vessels 11, 12. For example, vessel 11 is provided with deck beams 19, 20 that form an interface between each of the frames 13, 14 and the barge or vessel 11. Deck beams 19, 20 also provide an interface between each of the frames 13, 14 and the vessels or barges 11, 12. Multiple such beams 19, 20 can be used to form a load spreader platform 23, 24, 25, 26.

Figure 6:
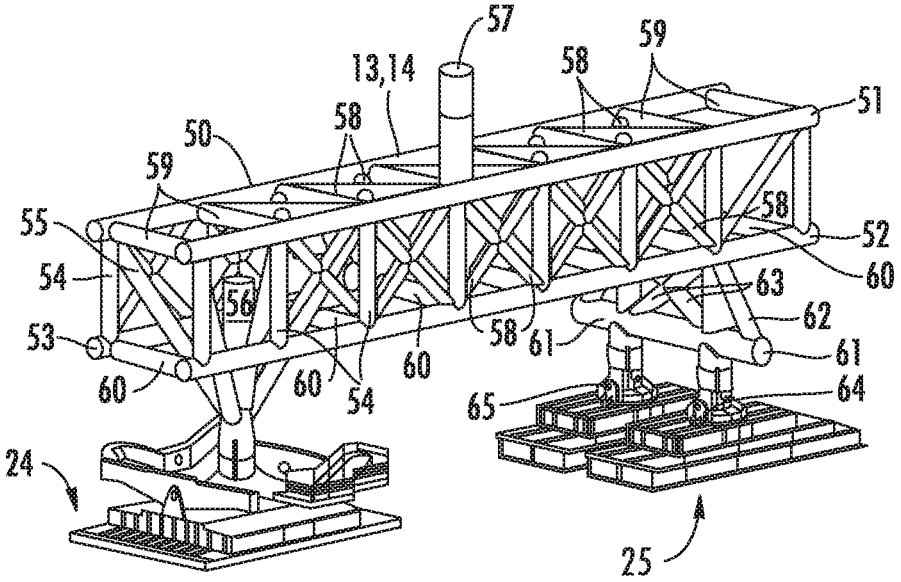
FIG. 6 is a partial perspective view of a preferred embodiment of the apparatus of the present invention wherein the hulls are removed for clarity.
Figure 7:
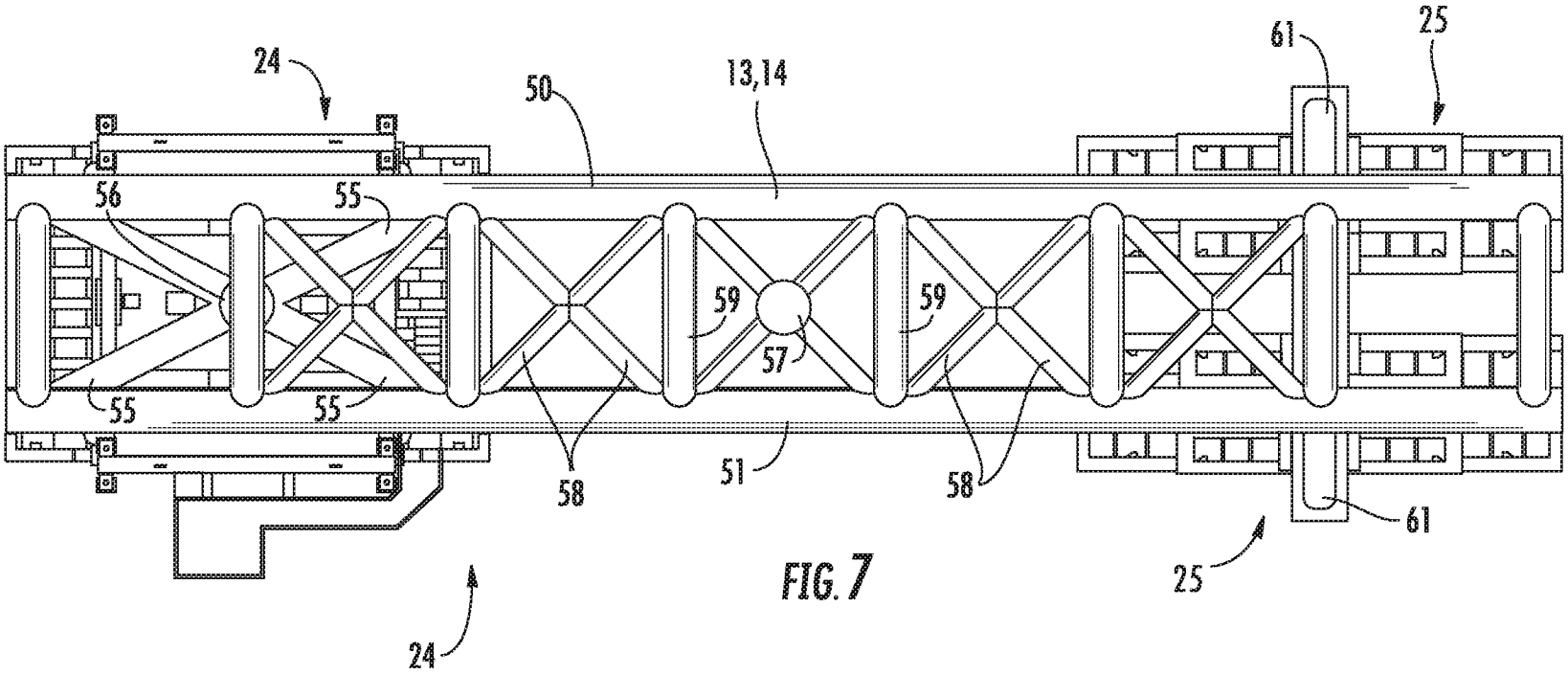
FIG. 7 is a partial plan view of a preferred embodiment of the apparatus of the present invention wherein the hulls are removed for clarity.
Figure 8:
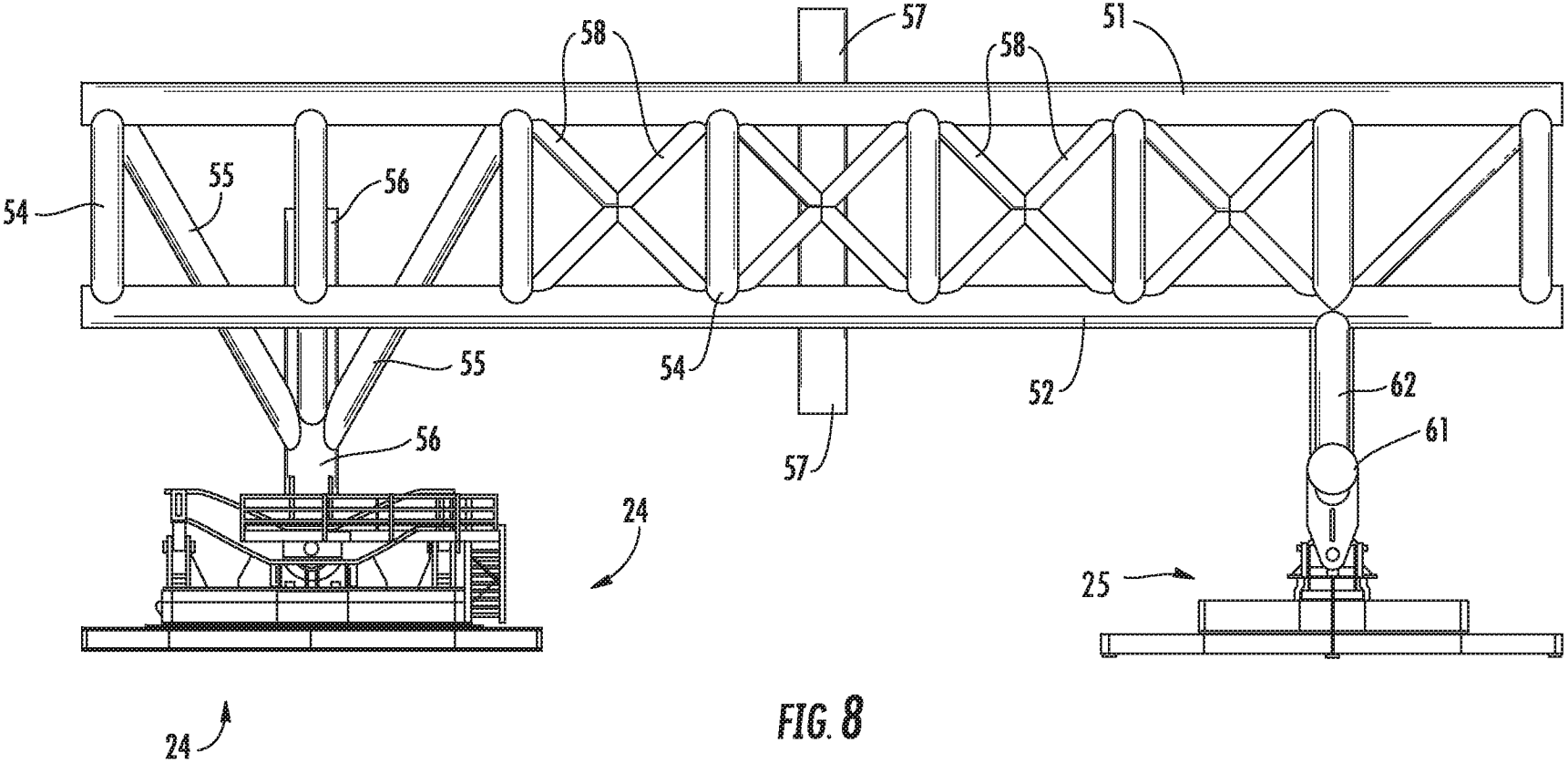
FIG. 8 is a partial elevation view of a preferred embodiment of the apparatus of the present invention wherein the hulls and crew quarters are removed for clarity.

Each of the frames 13, 14 can be in the form of a truss as shown in FIGS. 6-8. The frames 13, 14 can be similarly configured as seen in the drawings. Each frame 13, 14 can be in the form of a truss having longitudinal horizontal members 50, 51, 52, 53. Vertical members 54 connect one longitudinal horizontal member 50-53 to another longitudinal horizontal member 50-53 (see FIGS. 6-8). Posts 56, 57 connect to upper longitudinal horizontal members 50, 51 with diagonal members 55. The lower end of post 56 preferably attaches to universal joint 16, 18.

Cross bracing 58 can be provided such as spanning between the rectangular portions defined by upper and lower horizontal members 51, 52 and vertical members 54 (see FIG. 8). Cross bracing at 58 can also be provided between upper horizontal members 50, 51 (see FIGS. 6-7).

Upper transverse horizontal members 59 span between upper longitudinal members 50, 51. Similarly, lower transverse horizontal members 60 span between lower longitudinal members 52, 53. Horizontal beam 61 attaches to pivots or pivotal connections 64, 65 is seen in FIG. 6. Diagonal beams or supports 62 extend from beam 61 to lower longitudinal member 52 and to lower longitudinal member 53 (see FIGS. 6-7). Cross bracing 63 is provided between beam 61 and lower longitudinal members 52, 53. Post 57 can support a building 30, at least providing part of the support. Post 57 can support crane 36.

Hulls or vessels 11, 12 can be dynamically positioned. Dynamically positioned vessels 11, 12 can be used to support frames 13, 14. Dynamically positioned vessels 11, 12 are commercially available and are known. Dynamic positioning systems for vessels are commercially available. An example is the Kongsberg Simrad SBP10 work station. Such vessels 11, 12 can maintain a position even without the use of anchors. Dynamic positioning is a computer controlled system to automatically maintain a vessel's position and heading by preferably using the vessel's own propellers and/or thrusters. Position reference sensors, combined with wind sensors, motion sensors and gyro compasses, provide information to the computer pertaining to the vessel's position and the magnitude and direction of the environmental forces affecting its position. Typically, a computer program contains a mathematical model of the vessel that includes information pertaining to wind and current drag of the vessel and the location of the thrusters. This knowledge, combined with the sensor information, allows the computer to calculate the required steering angle and/or thruster output for each thruster. This arrangement allows operations at sea even if when mooring or anchoring is not feasible due to deep water, congestion on the sea bottom (pipelines, templates) or other problems.

Dynamic positioning may either be absolute in that the position is locked to a fixed point over the bottom, or relative to a moving object like another ship or an underwater vehicle. One may also position the ship at a favorable angle towards the wind, waves and current, called weathervaning. Dynamic positioning is much used in the offshore oil industry. There are more than 1,000 dynamic positioning ships in existence.

In FIGS. 1-5, dynamically positioned vessels 11, 12 each have a deck 21 or 22, pilot house or cabin 27, 31, bow 28, 32 and stern 29, 33. The dynamically positioned vessel 11 provides deck 21, pilot house 27, bow 28 and stern 29. Dynamically positioned vessel 12 provides a deck 22, pilot house 31, bow 32, stern 33. Crane 36 or other lifting device can be mounted to aft frame 14 as seen in FIGS. 1-3. Crane 36 can be mounted to post 37 having crane bearing 41 and boom bearing support post 44. Crane 36 provides boom 40 attached to operator's cabin 39 at pivotal connection 38.

Load spreader platforms can be provided to define an interface between each of the frames 13, 14 and the dynamically positioned vessels 11, 12. Load spreader platform 23 is positioned under pivotal connection 15, while load spreader platform 24 is positioned under universal joint connection 16. Load spreader platform 25 is positioned under pivotal connection 17, forming an interface between that connection 17 and the deck 22 of vessel 12. Similarly, load spreader platform 26 forms an interface between deck 22 of vessel 12 and universal joint connection 18 as shown in FIGS. 1-3.

In a preferred embodiment, the frames 13, 14 are positioned in between the pilot house 27 or 31 of each dynamically positioned vessel 11 or 12 and the stern 29 or 33 of each dynamically positioned vessel 11, 12. In a preferred embodiment, the dynamically positioned vessels 11, 12 are positioned so that both vessels 11, 12 have the bow 28, 32 pointed in the same direction and the stern 29, 33 pointed in the same direction, as shown in FIGS. 1-3.

In FIGS. 1-3, a first crew quarters, personnel housing or hotel 30 is a forward housing unit that is mounted on and supported by supports 42 and post 43 of truss 45 which is a part of forward frame 13.

Figure 4:
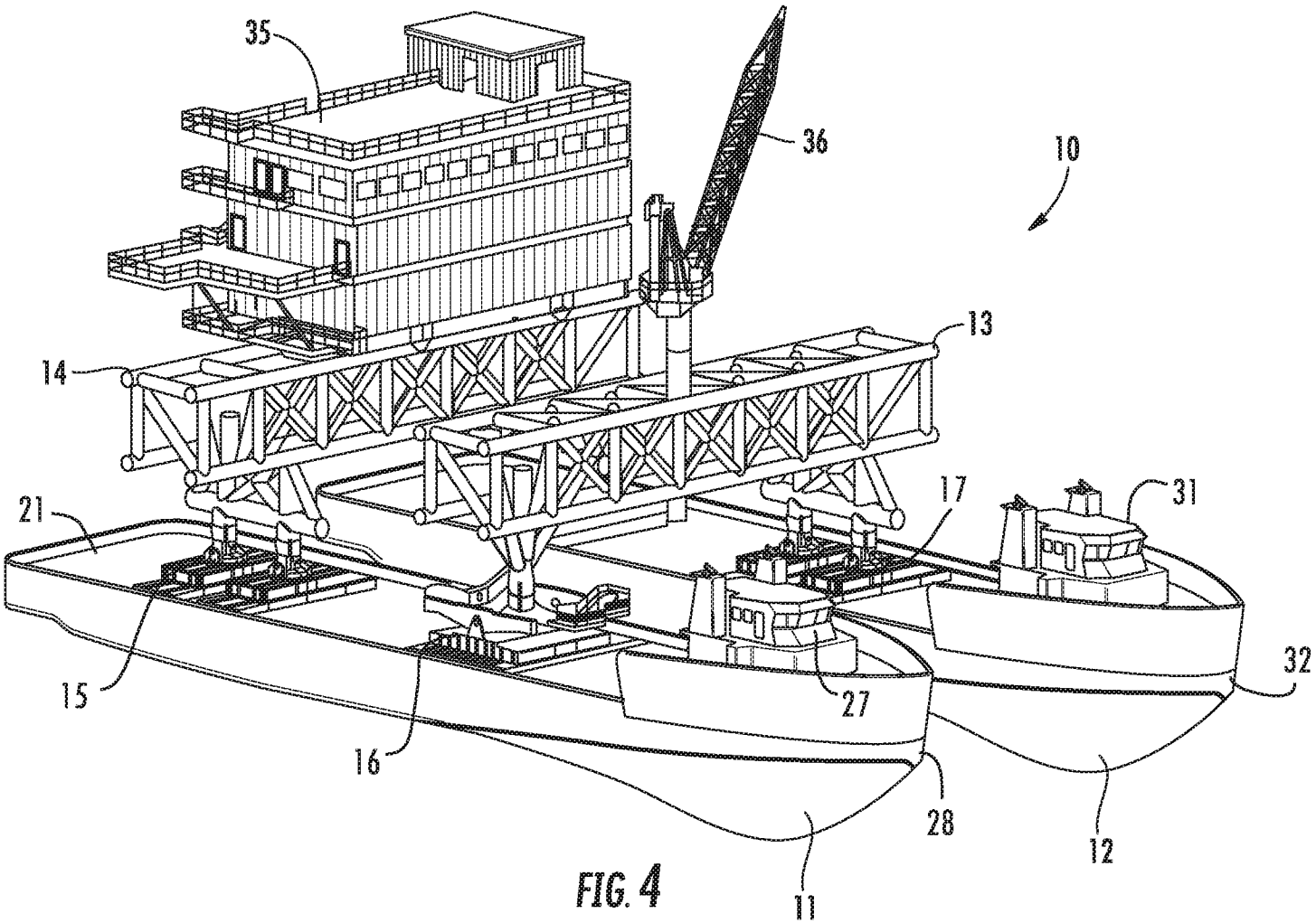
FIG. 4 is a perspective view of a preferred embodiment of the apparatus of the present invention.
Figure 5:
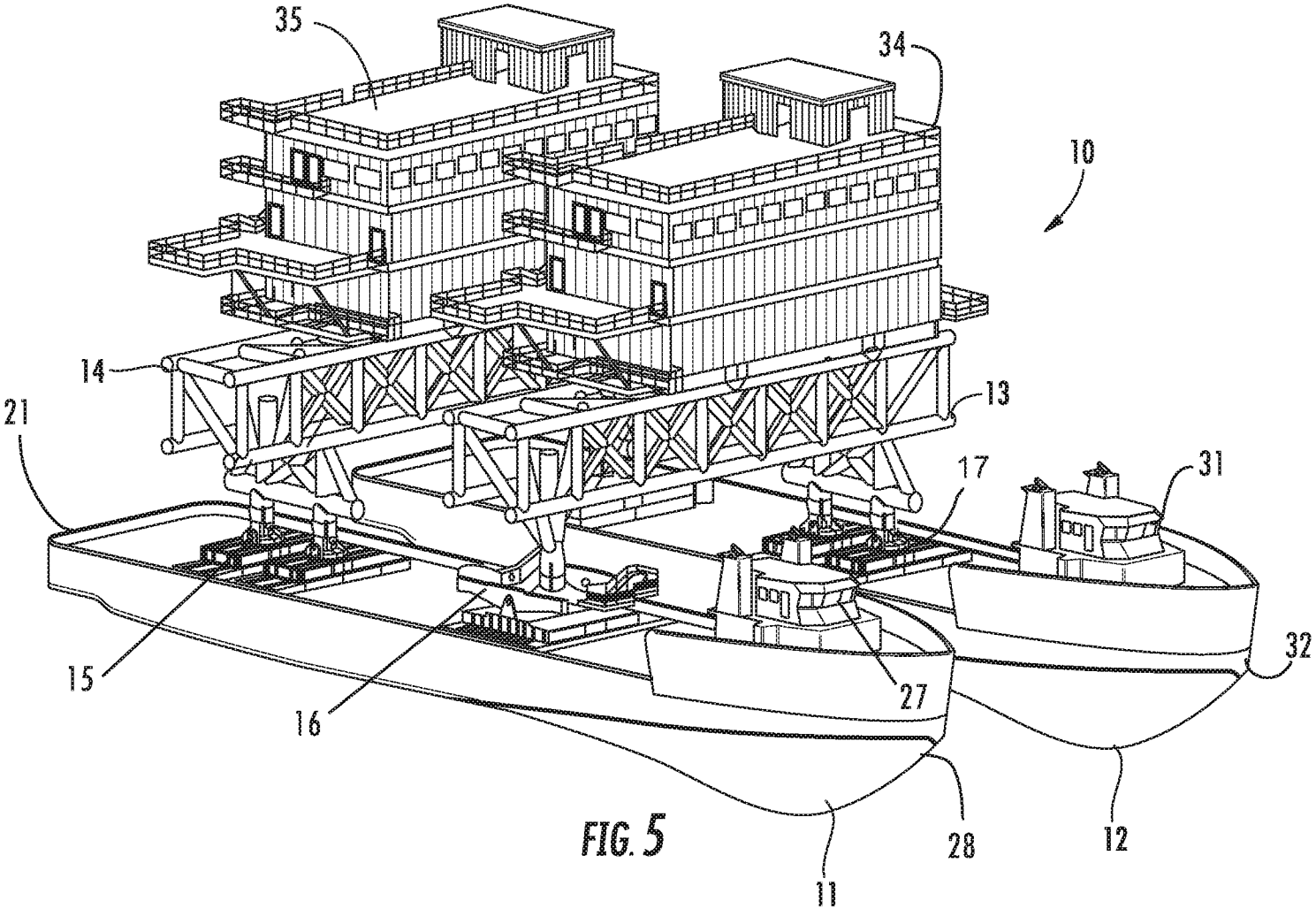
FIG. 5 is a perspective view of a preferred embodiment of the apparatus of the present invention wherein each frame supports a crew quarters, hotel or multi-unit housing or dwelling.

In FIGS. 4-5, crew quarters can be provided on aft frame 14 (FIG. 4) or on both frames 13, 14 (FIG. 5). In FIG. 4, the crew quarters or personnel housing is an aft building or quarters 35 mounted on aft frame 14. In FIG. 5, a second housing or crew quarters 34 is provided in addition to the first personnel housing or crew quarters 30, 35. In FIG. 4, crane 36 is mounted to forward frame 13. FIGS. 6-8 show a frame 13, 14 in more detail.

Dynamic Positioning System

Figure 9:
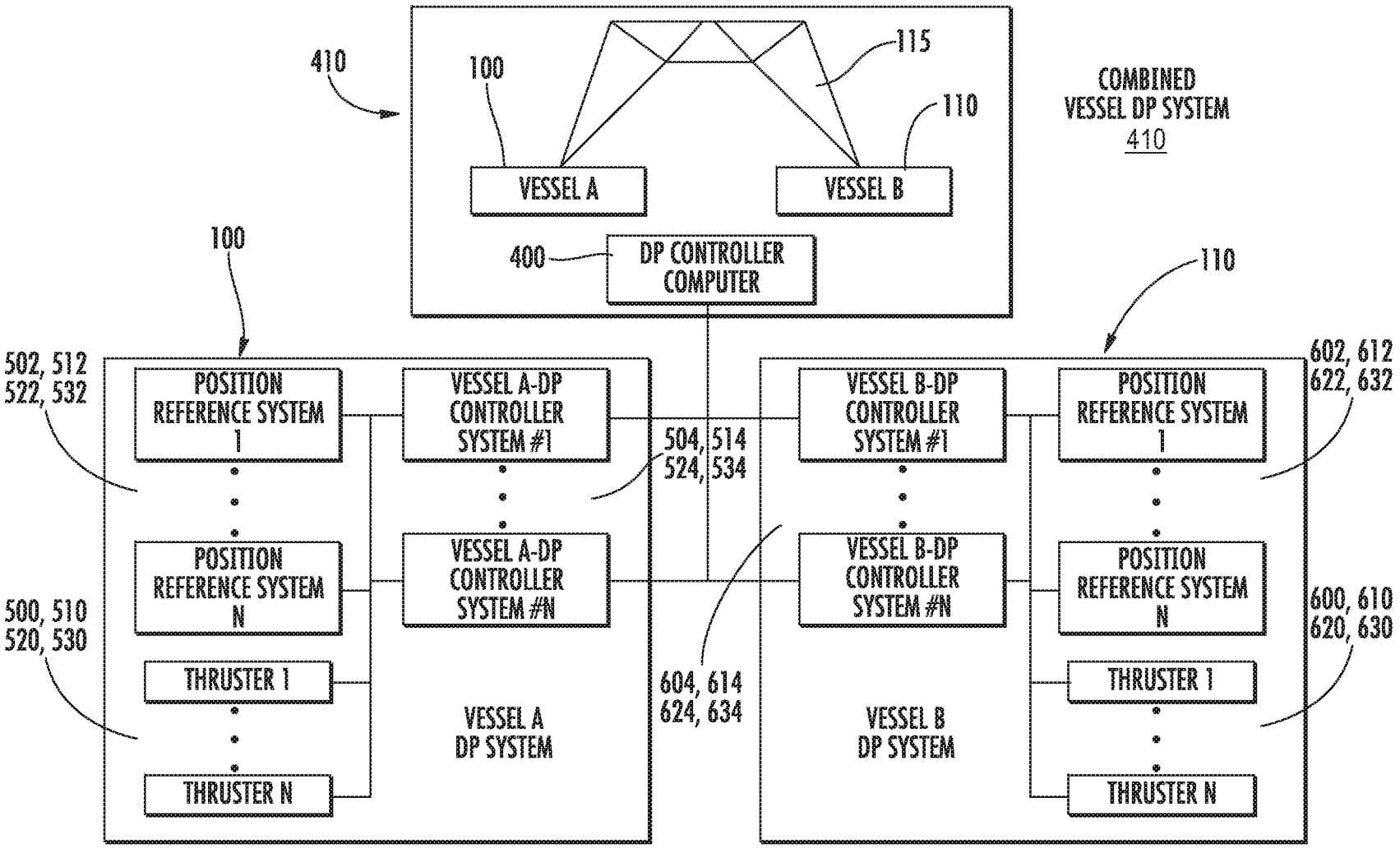
FIG. 9 is a schematic diagram of one embodiment of the method and apparatus incorporating a combined vessel DP system.

FIG. 9 is a schematic diagram of an overall structurally integrated vessel 410 schematically showing the integration of vessel 100 and vessel 110 incorporating an overall combined vessel DP system 410. As used herein, "DP" means "dynamically positioned".

Figure 10:
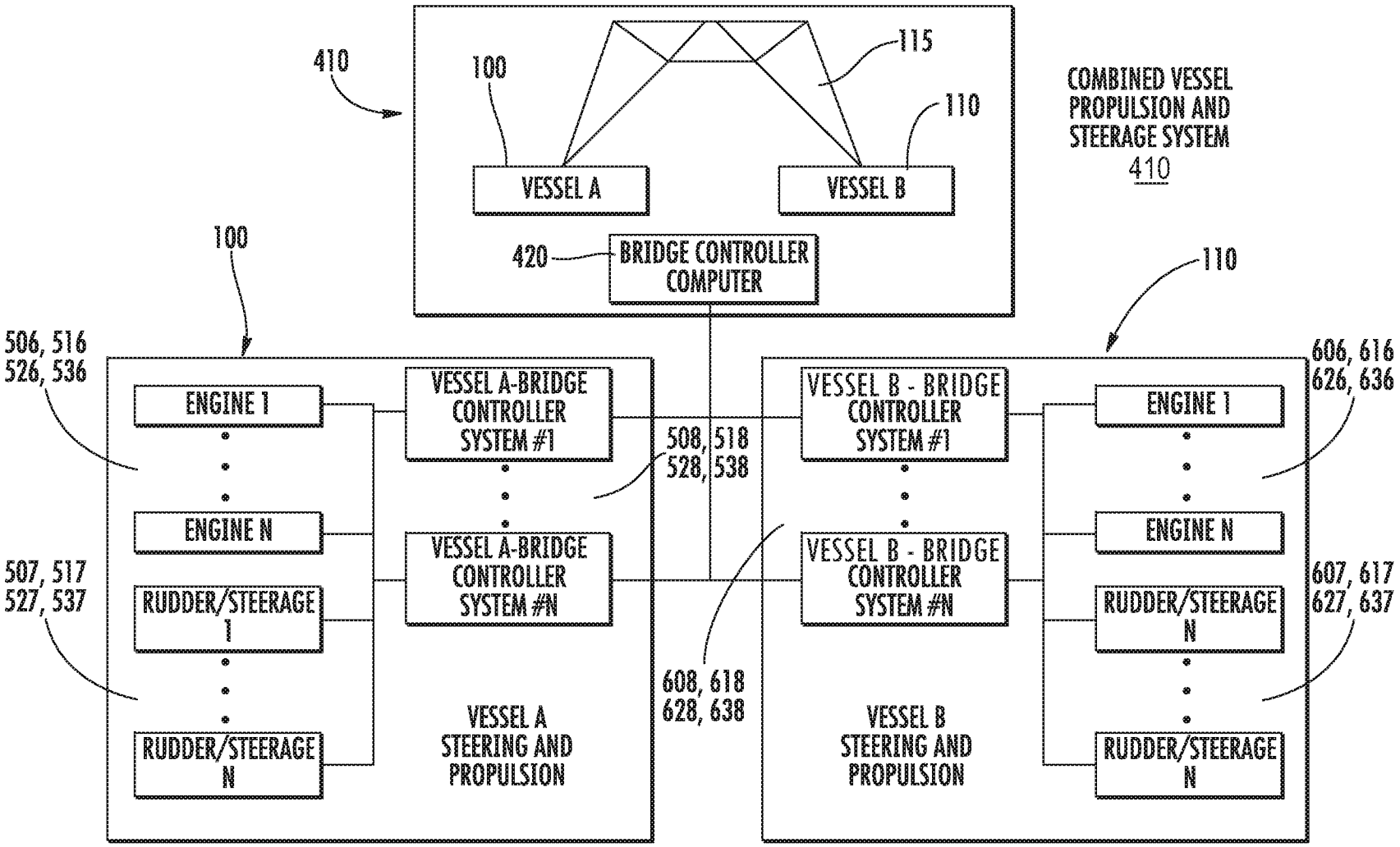
FIG. 10 is a schematic diagram of another embodiment of the method and apparatus incorporating a combined vessel propulsion and steerage system.

FIG. 10 is a schematic diagram of an overall structurally integrated vessel 410 schematically showing the integration of vessel 100 and vessel 110 and incorporating an overall combined vessel propulsion and steerage system 410. In FIGS. 9 and 10, the numeral 115 represents the frames 13, 14 of FIGS. 1-8. In each embodiment of FIGS. 9-10, there can be provided personnel housing/crew quarters 30.

Structurally integrating two existing stand alone vessels 100 and 110 (having conventional propulsion and dynamic positioning systems) thereby forming a single overall vessel/system 410, can enhance the performance of both the propulsion and the dynamic positioning systems for the two integrated vessel/system. For example, structurally integrating two existing vessels (each having a class of DP system such as DP class 1) will cause the DP system of the structurally integrated vessel to be a higher class such as DP 2 (because the combined/integrated vessels, propulsion systems, and DP systems form a single integrated system).

The performance of the propulsion system for the combined system will also be superior when compared to the performance of the existing individual vessels.

For example, the structurally combined and integrated vessel system 410 will have multiple independently operable engine rooms and multiple fuel supplies, thereby providing greater propulsion redundancy. The loss of one of the main engine rooms due to flood or fire, or the contamination of an engine room fuel supply on one of the vessels will no longer result in the loss of propulsion for the combined system as the redundant engine room will still be operable.

Similarly, steerage for the structurally combined and integrated vessel system can still be achieved given the loss of steerage (rudder or equivalent system) on one of the individual vessels.

All of the above make the performance of the combined system superior to the performance of the existing individual systems without fundamental change or modification to the individual vessels. It is structurally combining and integrating the vessels through the use of bottom feeder gantries which lead to the performance improvements.

Supporting Data

The "quality" of a dynamic positioning system can be measured via the following:

Robustness of the system. This is a measure of how many components within the DP system can fail and the DP system remain able to maintain station keeping capabilities. The international standard for this is to assign a rating or classification to the DP system. Generally, there are three ratings: Class 1, Class 2 and Class 3. Higher classes of DP system have greater degrees of design redundancy and component protection.

The integration of two lower level DP class vessels will automatically result in higher levels of component and system redundancy.

The ability of the system to maintain station within a given set of wind, wave, and current conditions is generally referred to as "Capability." The higher the "Capability" of a vessel, the worse the conditions the vessel can stay on location during such conditions. "Capability" itself is a function of:

thruster horsepower (or equivalent), numbers of thrusters, and disposition (location) of thrusters around the vessel which will influence a thruster's ability to provide restoring force capability.

Through the structural combination and integration of two vessels of given "capabilities", the "Capability" of the structurally combined and integrated vessel is increased compared to the "capability" of either vessel before such combination and integration. Increased "Capability" will be the result of:

(a) there being more thrusters in the structurally combined and integrated system, and (b) the thrusters having a better spatial distribution in the structurally combined and integrated system (meaning that the thrusters can provide a greater restoring capability to the combined and integrated system compared to either vessel alone).

Additionally, the capability of the overall DP system in the structurally combined and integrated vessel will be superior even given the loss of one of the components of one of the DP systems in one of the vessels for the same reasons as specified in (a) and (b) above.

Damaged system capability is also another recognized measure of DP system quality.

Structurally Combined and Integrated First and Second Vessels to Create a Singled Combined Vessel DP Combination In one embodiment, a first vessel 100 and a second vessel 110 are structurally combined and integrated, the (1) first vessel 100 comprising:

(a) a hull, (b) a thruster 500, 510, 520, 530 for the first vessel 100 powering the hull of the first vessel 100, (c) a position referencing system 502, 512, 522, 532 for the first vessel 100 providing the position of the first vessel 100, and (d) a DP controller system 504, 514, 524, 534 for the first vessel 100 operatively connected to the first thruster 500, 510, 520, 530 of the first vessel 100 and first position referencing system 502, 512, 522, 532 of the first vessel 100;

(2) second vessel 110 comprising:

(a) a hull, (b) a thruster 600, 610, 620, 630 for the second vessel 110 powering the hull of the second vessel 110, (c) a position referencing system 602, 612, 622, 632 for the second vessel 110 providing the position of the second vessel 110, (d) a DP controller system 604, 614, 624, 634 for the second vessel 110 operatively connected to the thruster 600, 610, 620, 630 for the second vessel 110 and position referencing system 602, 612, 622, 632 for the second vessel 110;

and including an overall DP controller computer 400 operatively connected to both the DP controller system 504, 514, 524, 534 for the first vessel 100 and the DP controller system 604, 614, 624, 634 for the second vessel 110, wherein the overall DP controller computer 400 can directly or indirectly control one or more of the following:

(I) thruster 500, 510, 520, 530 for the first vessel 100, (ii) position referencing system 502, 512, 522, 532 for the first vessel 100, (iii) thruster 600, 610, 620, 630 for the second vessel 110, and (iv) position referencing system 602, 612, 622, 632 for the second vessel 110.

In one embodiment the first and/or second vessels 100, 110 are used vessels and taken out of service to be structurally combined and integrated.

In one embodiment a first vessel 100 and a second vessel 110 are structurally combined and integrated, the (1) first vessel 100 comprising:

(a) a hull, (b) a plurality of thrusters 500, 510, 520, 530 for the first vessel 100, each powering the hull of the first vessel 100, (c) a plurality of position referencing systems 502, 512, 522, 532 for the first vessel 100, each providing the position of the first vessel 100, and (d) a plurality of DP controller systems 504, 514, 524, 534 for the first vessel 100, each being operatively connected to the plurality of thrusters 500, 510, 520, 530 for the first vessel 100 and plurality of position referencing systems 502, 512, 522, 532 for the first vessel 100;

(2) second vessel 110 comprising:

(a) a hull, (b) a plurality of thrusters 600, 610, 620, 630 for the second vessel 110, each powering the hull of the second vessel 110, (c) a plurality of position referencing systems 602, 612, 622, 632 for the second vessel 110, each providing the position of the second vessel 110, (d) a plurality of DP controller systems 604, 614, 624, 634 for the second vessel 110, each being operatively connected to the plurality of thrusters 600, 610, 620, 630 for the second vessel 110 and plurality of position referencing systems 602, 612, 622, 632 for the second vessel 110;

and having an overall DP controller computer 400 operatively connected to both the DP controller 504, 514, 524, 534 for the first vessel 100 and the DP controller 604, 614, 624, 634 for the second vessel 110 wherein the DP controller computer can directly or indirectly control any of the following:

(I) one or more of the thrusters 500, 510, 520, 530 for the first vessel 100, (ii) one or more of the position referencing systems 502, 512, 522, 532 for the first vessel 100, (iii) one or more of the thrusters 600, 610, 620, 630 for the second vessel 110, and (iv) one or more of the position referencing systems 602, 612, 622, 632 for the second vessel 110.

Steering and Propulsion Combination (FIG. 10)

In one embodiment a first vessel 100 and a second vessel 110 are structurally combined and integrated, the (1) first vessel 100 comprising:

(a) a hull, (b) an engine 506, 516, 526, 536 for the first vessel 100 powering the hull of the first vessel 100, and (c) a steerage system 507, 517, 527, 537 for the first vessel 100 steering the first vessel 100;

(d) a bridge controller system 508, 518, 528, 538;

(2) second vessel 110 comprising:

(a) a hull, (b) an engine 606, 616, 626, 636 for the second vessel 110 powering the hull of the second vessel 110, and (c) a steerage system 607, 617, 627, 637 for the second vessel 110 steering the second vessel 110;

(d) a bridge controller system 608, 618, 628, 638;

and including an overall bridge controller computer 420 operatively connected to each of the engines 506, 516, 526, 536 for the first vessel 100, steerage systems 507, 517, 527, 537 for the first vessel 100, engines 606, 616, 626, 636 for the second vessel 110, and steerage systems 607, 617, 627, 637 for the second vessel 110, wherein the overall bridge controller computer 420 can directly or indirectly control one or more of the following:

(I) engine 506, 516, 526, 536 for the first vessel 100, (ii) steerage system 507, 517, 527, 537 for the first vessel 100, (iii) engine 606, 616, 626, 636 for the second vessel 110, and (iv) steerage system 607, 617, 627, 637 for the second vessel 110.

In one embodiment, the overall bridge controller computer 420 is located on one of the two vessels 100, 110.

In one embodiment, the first and/or second vessels 100, 110 are used vessels and taken out of service to be structurally combined and integrated.

In one embodiment a first vessel 100 and a second vessel 110 are structurally combined and integrated, the (1) first vessel 100 comprising:

(a) a hull, (b) a plurality of engines 506, 516, 526, 536 for the first vessel 100, each powering the hull of the first vessel 100, and (c) a plurality of steerage systems 507, 517, 527, 537 for the first vessel 100, each steering the first vessel 100;

(2) second vessel 110 comprising:

(a) a hull, (b) a plurality of engines 606, 616, 626, 636 for the second vessel 110, each powering the hull of the second vessel 110, and (c) a plurality of steerage systems 607, 617, 627, 637 for the second vessel 110, each steering the second vessel 110, and including an overall bridge controller computer 420 operatively connected to each of the engines 506, 516, 526, 536 for the first vessel 100, steerage systems 507, 517, 527, 537 for the first vessel 100, engines 606, 616, 626, 636 for the second vessel 110, and steerage systems 607, 617, 627, 637 for the second vessel 110, wherein the overall bridge controller computer 420 can directly or indirectly control the following:

(i) one or more of the engines 506, 516, 526, 536 for the first vessel 100, (ii) one of more of the steerage systems 507, 517, 527, 537 for the first vessel 100, (iii) one or more of the engines 606, 616, 626, 636 for the second vessel 110, and (iv) one or more of the steerage systems 607, 617, 627, 637 for the second vessel 110.

FIGS. 11-14 show another embodiment of the apparatus of the present invention designated generally by the numeral 66. Oil production apparatus or catamaran floating oil/gas production apparatus 66 has a pair of spaced apart hulls, vessels or barges 67, 68. Frames 69, 70 are spaced apart from each other, each frame supported by vessels or hulls 67, 68 as seen in FIGS. 11-14. Hulls 67, 68 can be existing barges or support vessels or new custom built barges or support vessels. Hulls 67, 68 can provide oil and condensate storage. Produced oil and condensate could also be stored in an attending floating storage and offloading tanker 82 via flexible hose connection 84. The apparatus 66 can be positioned on a selected locale or station by spread mooring, taut leg mooring, or dynamic positioning.

As with the embodiments of FIGS. 1-10, catamaran floating oil production apparatus 66 connects each frame 69 or 70 to each vessel or hull 67, 68 with connections. Frame 69 connects to vessel or hull 68 with a hinge/pivot/pivotal connection 86. Frame 69 connects to vessel or hull 67 with universal joint connection 87. Frame 70 connects to vessel or hull 68 with a universal joint connection 88. Frame 70 connects to vessel or hull 67 with a hinge/joint/pivot/pivotal connection 85 (see FIGS. 11-14).

Figure 11:
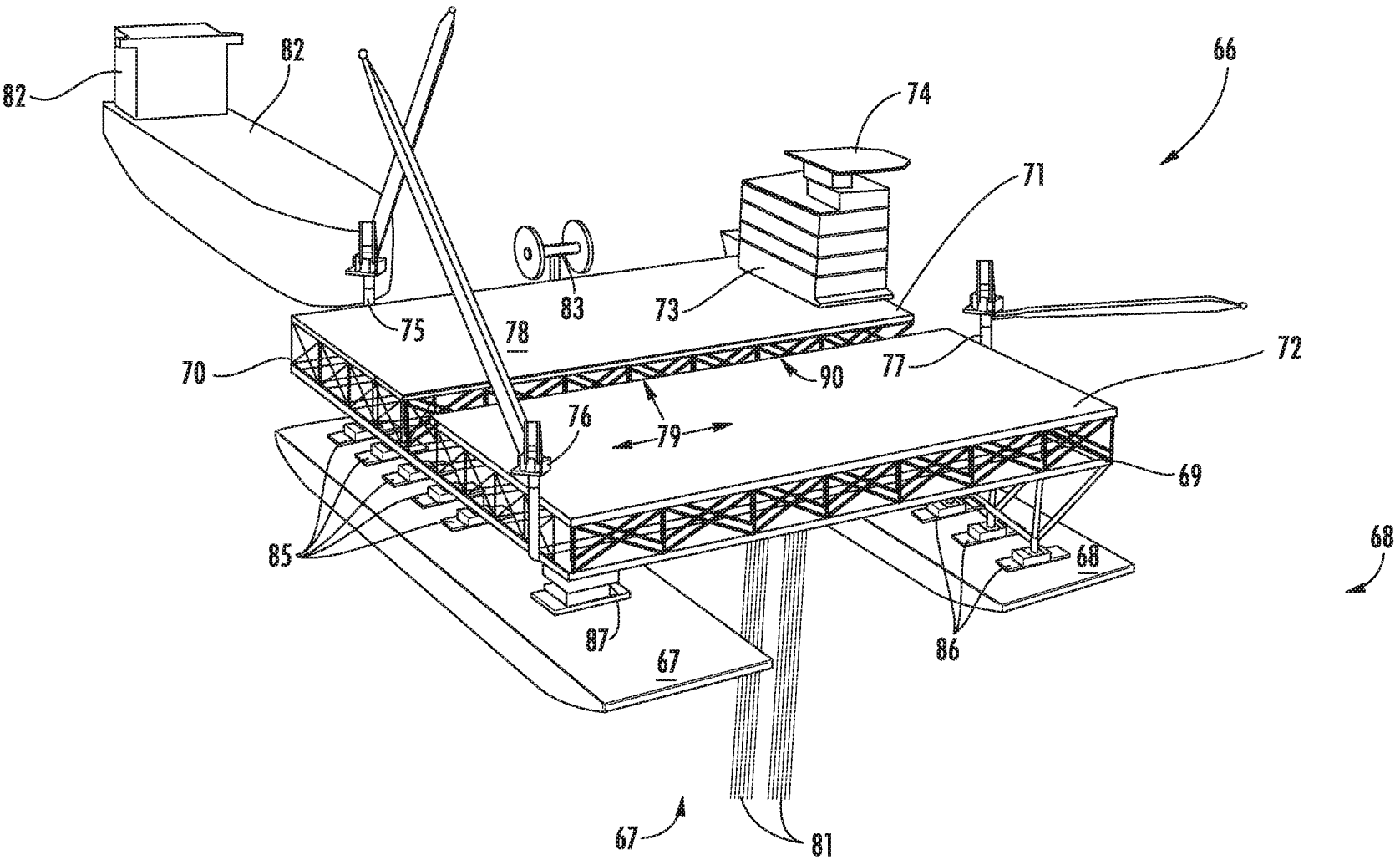
FIG. 11 is a perspective view of an alternate embodiment of the apparatus of the present invention.
Figure 12:
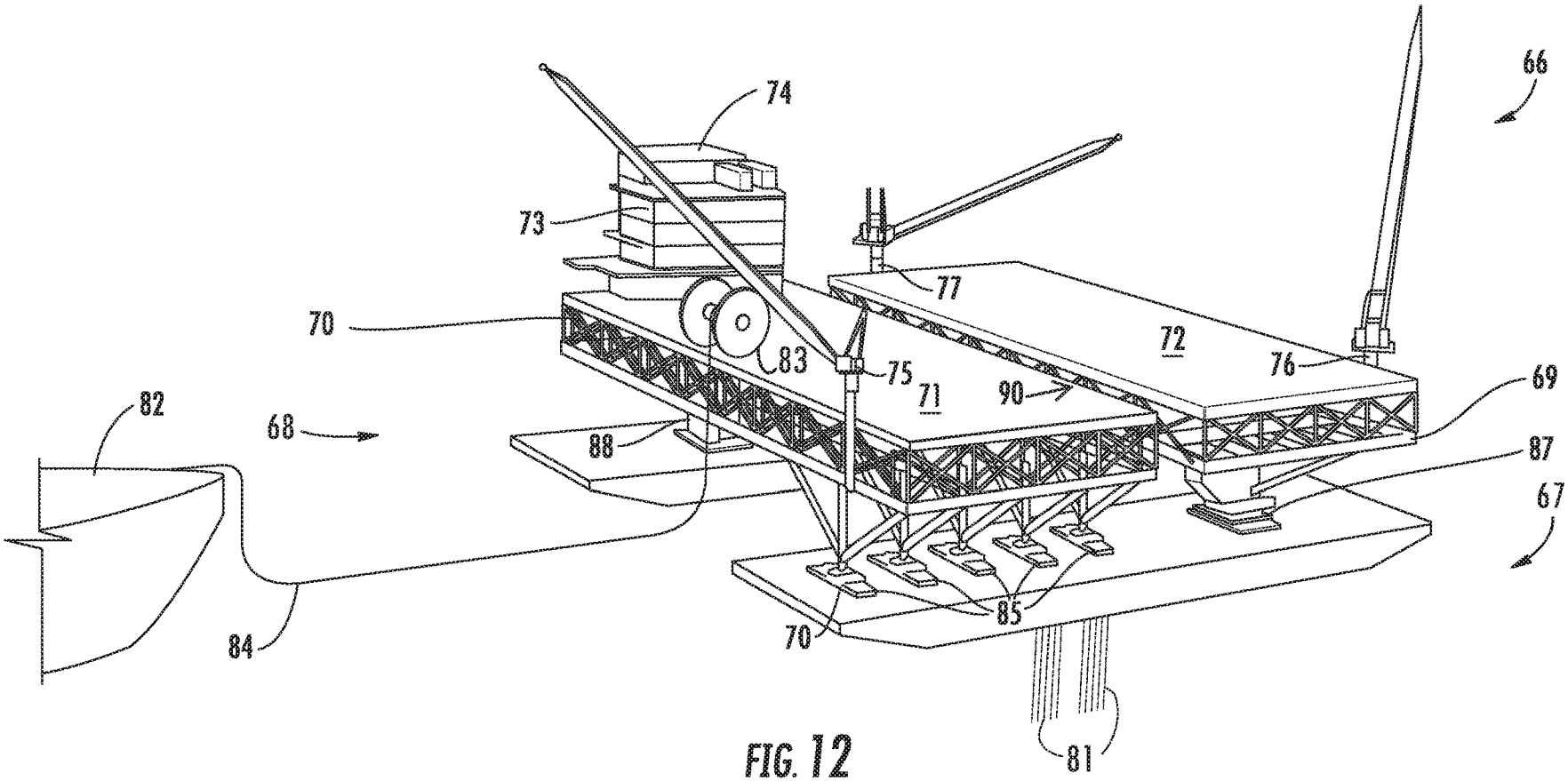
FIG. 12 is a perspective view of an alternate embodiment of the apparatus of the present invention.
Figure 13:
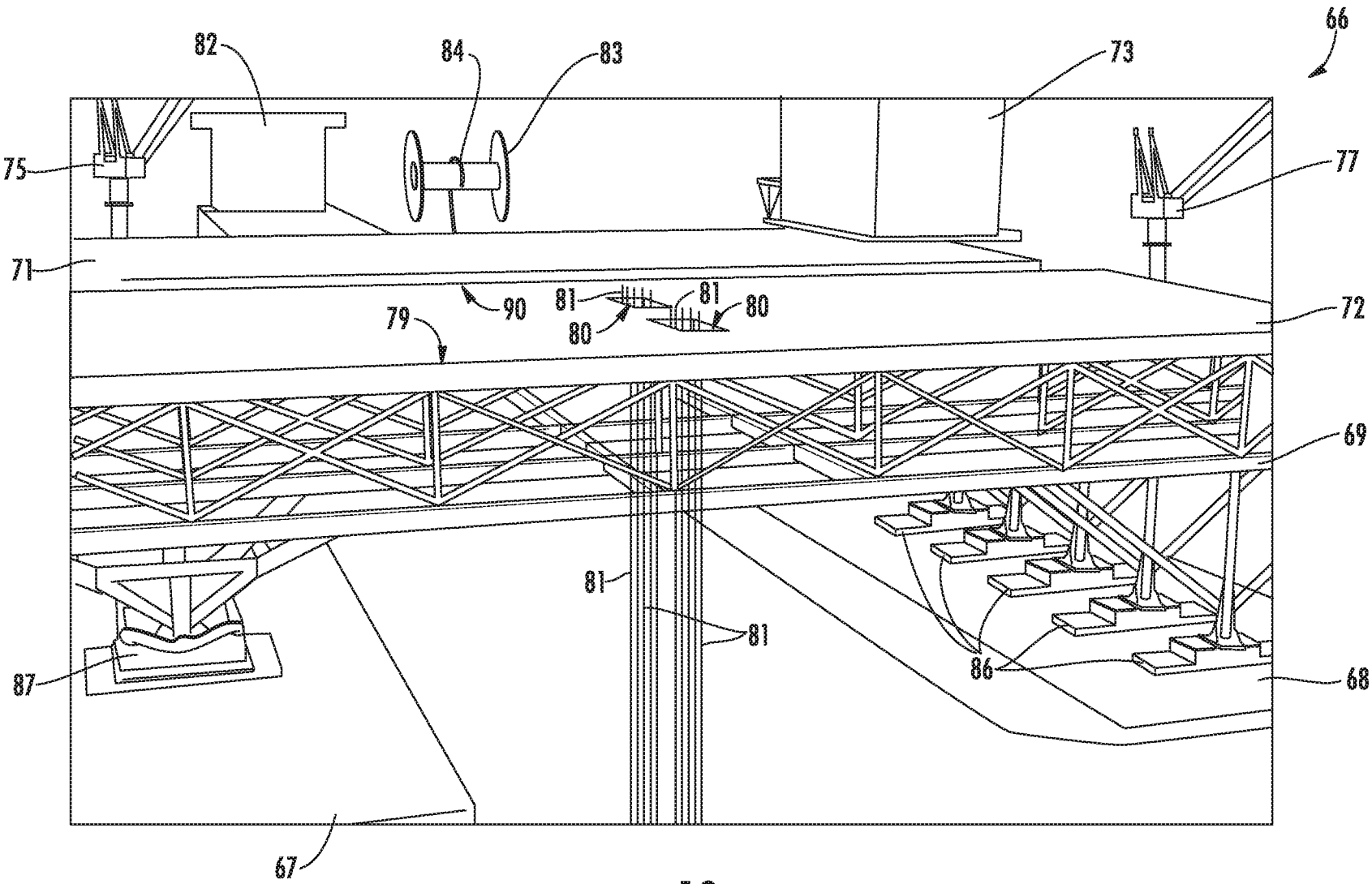
FIG. 13 is a partial perspective view of an alternate embodiment of the apparatus of the present invention.
Figure 14:
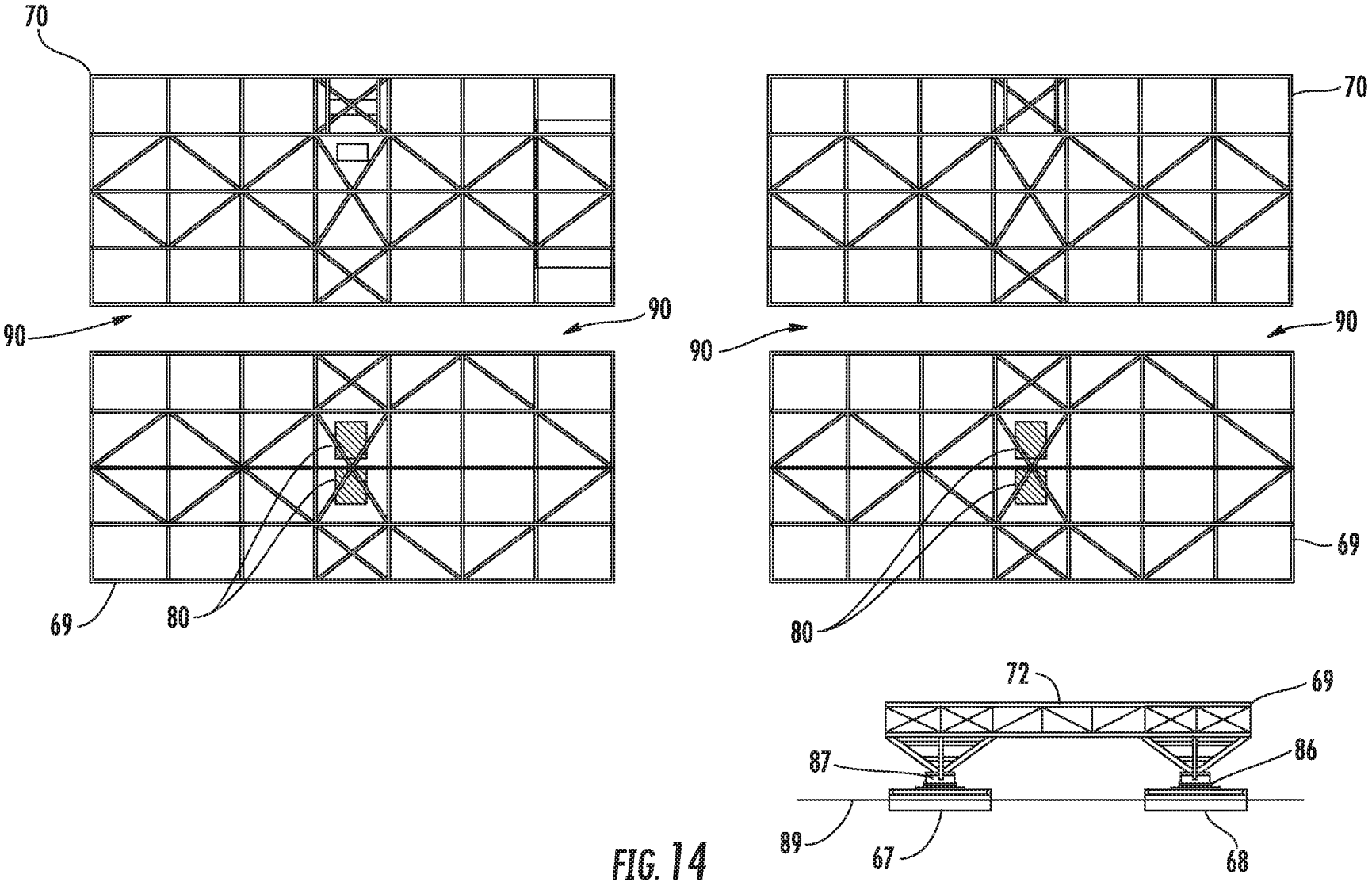
FIG. 14 is a diagram of an alternate embodiment of the apparatus of the present invention showing top side optional arrangements.

Each frame 69, 70 supports an oil production platform. Oil production platform 71 is supported by frame 70. Oil production platform 72 is supported by frame 69 as seen in FIGS. 11-13. A space 90 is positioned in between the frames 69,70 and platforms 71, 72. Thus, each oil production platform 71, 72 is able to move with its frame independently of the other oil production platform.

The platforms 71, 72 each have a deck that can carry any of various components useful in production of oil and/or gas. For example, in FIGS. 11 and 12, platform 71 has crew quarters or personnel building 73, heliport 74 and crane 75. Spool 83 can be mounted to platform 71. Platform 72 can have additional cranes 76, 77 and deck openings 80 that are receptive of riser pipes 81. One or more production riser pipes 81 run from subsea wells to the surface, each riser pipe suspended from one or both of the frames 69, 70 or from one or both hulls 67, 68. Each platform 71,72 can have a platform deck. In the drawings, platform 71 has deck 78. Platform 72 has deck 79. One or more gas injection risers can be provided, running from the surface and suspended from one or both frames 69, 70 or from one or both hulls 67, 68 to subsea gas injection wells. One or more injection risers can be provided running from the surface and suspended from one or both frames 69, 70 or from one or both hulls 67, 68 to subsea water injection wells.

Spool 83 can store an elongated flow line, hose or conduit 84 that enables transfer of oil between platform 71 or 72 and tanker 82. Each hull or vessel 67, 68 can be used to contain oil that is transferred from a subsea well to apparatus 66 using risers or riser pipes 81. Piping (not shown) on platforms 71, 72 can be provided for transmission of oil from risers or riser pipes 81 to hulls 67, 68 or to flow line 84 and then to tanker 82.

Figure 16:
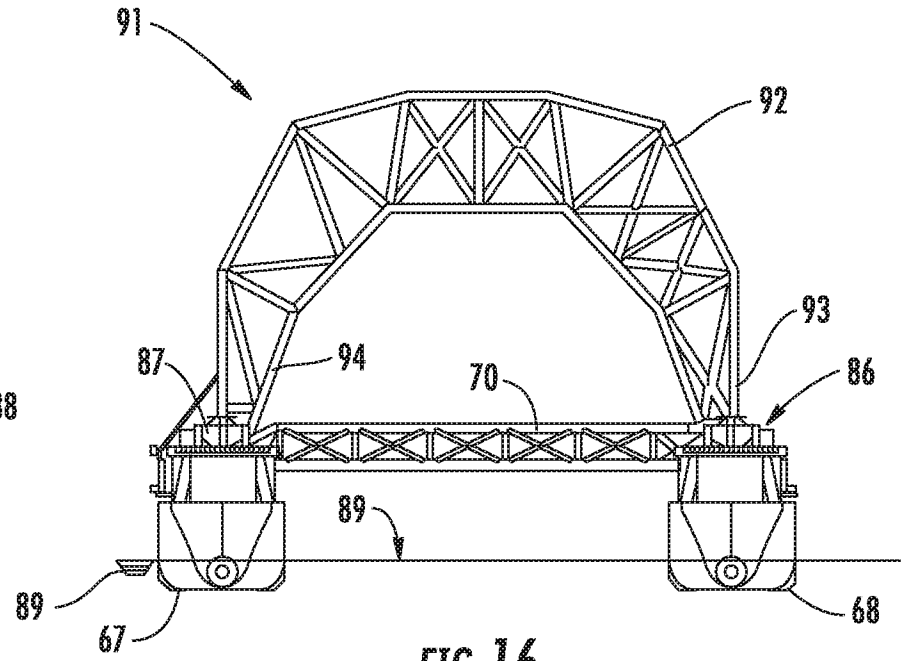
FIG. 16 is a perspective view of another embodiment of the apparatus of the present invention showing an alternate arrangement having utility in the hostile marine environments such as North Sea area.
Figure 15:
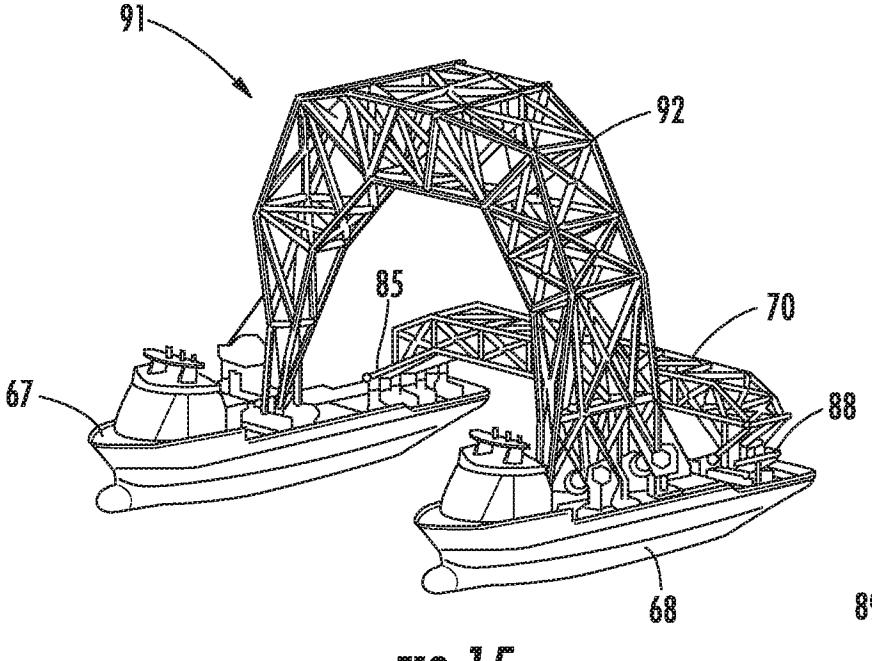
FIG. 15 is a perspective view of another embodiment of the apparatus of the present invention showing an alternate arrangement having utility in hostile marine environments such as the North Sea area.

FIGS. 15-16 show an alternate embodiment of the apparatus of the present invention, designated generally by the numeral 91 on water surface 89. Vessels 67, 68 are provided. Frame 70 can be the same as frame 70 of FIGS. 11-14, connecting to vessel 67 at hinge/pivot/pivotal connection 85 and to vessel 68 with universal joint connection 88. In FIGS. 15-16, frame 69 is replaced with an arch shaped frame 92 having lower end portions 93, 94. Lower end portion 93 attaches to vessel 68 with pivot/pivotal connection/hinge 86. Lower end portion 94 connects to vessel 67 with universal joint connection 87. As with the embodiment of FIGS. 11-14, frame 70 can support an oil production platform 71 (or 72) with a deck and selected oil production components such as crew quarters 73, crane(s) 75, 76, 77, riser pipes 81, riser pipe openings(s) 80, spool(s) 83, heliport 74 or other selected oil and/or gas well drilling components or equipment. The embodiment of FIGS. 15-16 has particular utility for hostile marine environments such as the North Sea.

Figure 17:
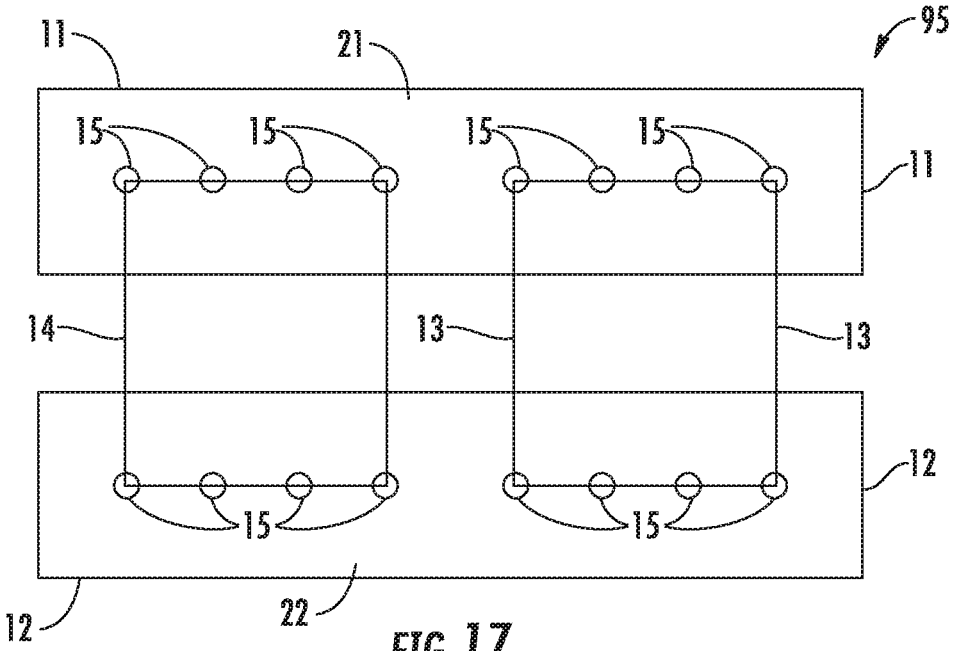
FIG. 17 is a plan view of an alternate embodiment of the apparatus of the present invention.

FIG. 17 shows a plan view of an alternate embodiment of the apparatus 95 having two frames or gantries 13, 14 supported on two vessels, hulls, or barges 11, 12. Hinged connections 15 (e.g., four (4)) are provided at spaced apart intervals to form a connection between each frame or gantry 13, 14 and the barges 11, 12. In this configuration, the hinged or pinned connections 15 provide roll releases only. In this embodiment of FIG. 17, there is no single pin-in-pin connection option between one side of a gantry or frame 13, 14 and the vessel, hull or barge 11, 12. The embodiment of FIG. 17 results in there being no relative motion between the two frames or gantries 13, 14. Note also that with this configuration of FIG. 17, any number of gantries or frames 13, 14 could be connected to the barges, hulls or vessels 11, 12. The same applications currently described for other embodiments would also work with this embodiment, including accommodations, production platforms, and others described herein.

The embodiment of FIG. 17 can provide a floating oil production apparatus or crew quarters that employs first and second vessels 11, 12, each said vessel 11, 12 having a vessel deck 21, 22 that is elevated above a surrounding water surface 89. A first frame or gantry 13 spans between the vessels 11, 12. A second frame 14 spans between the vessels 11, 12. Each of the frames 13, 14 can be configured like the frames 13, 14 in FIGS. 1-8 and 11-14. Each frame 13, 14 can include a horizontally extending truss having first and second end portions and vertically extending truss sections each extending from the horizontally extending truss portion downwardly below the horizontally extending truss section (e.g. see FIG. 8). The frames 13, 14 are spaced apart and connect to the vessels 11, 12 in a configuration that spaces the vessels 11, 12 apart as seen in the plan view of FIG. 17.

Each of the frames is connected to each of the vessel decks with hinged connections 15. In FIG. 17, there are four (4) hinged or pivotal connections 15 of frame 13 to vessel 11 and four (4) hinged or pivotal connections 15 of frame 13 to vessel 12. Similarly there are four (4) hinged or pivotal connections 15 of frame 14 to vessel 11 and four (4) hinged or pivotal connections 15 of frame 14 to vessel 12.

An oil production platform 71 or 72 or crew quarters 30 can be supported on only one of the frames. However, each of the frames 13, 14 can support an oil production or drilling platform 71 or 72 or crew quarters 30.

As with the embodiments of FIGS. 1-16, one or more risers 81 can extend between the seabed and the production or drilling platform 71 or 72.

One or both vessels 11, 12 can be dynamically positioned vessels.

One or both of the vessels 11, 12 can have a pilot house 31 and the dynamic positioning functions of each vessel 11, 12 can be controlled from the single said pilot house 31.

The horizontally extending truss has a lower portion elevated above the vessel decks and an upper portion spaced above said lower portion.

The oil production platform or drilling platform rests upon said upper portion of the horizontally extending truss.

The hinged connection 15 can include multiple spaced apart pinned connections.

Each frame can extend a distance that is greater than the spacing between the vessels.

Each frame upper portion can occupy a plane.

The dynamic positioning functions of at least one vessel 11 or 12 include thruster functions, steering functions and propulsion functions.

The dynamic positioning functions of both vessels 11, 12 can include thruster functions, steering functions and propulsion functions.

Each frame can have a deck portion 21 or 22 and the vertically extending truss sections span between the deck portions 21, 22 and the horizontally extending truss section.

Multiple load spreader platforms 23-26 can be attached to the deck portions 21, 22. The first and second frames 13, 14 can each be mounted on load spreader platforms 23-26.

Each vessel 11, 12 can be a work boat (e.g. see FIGS. 1-5) having a bow portion 28 with a pilot house 27, a deck portion 21 behind the pilot house 27, one or more load spreader platforms 23, 24 attached to the deck portion 21 and wherein the first and second frames 13, 14 are mounted on the one or more load spreader platforms 23, 24.

Each frame 13, 14 can support an oil production platform or oil well drilling platform 71, 72.

The system of the present invention can be mooring using a spread mooring system or dynamic positioning (DP). The spread mooring can be achieved using a wide range in number of mooring lines (e.g., from 4 to 16 individual lines). The mooring lines can be constructed from all steel wire, all steel chain, a combination of steel wire and steel chain, a combination of steel wire and clump weights, a combination of steel wire, steel chain and clump weights, a combination of steel wire and fiber rope, or a combination of steel chain and fiber rope.

Figure 18:
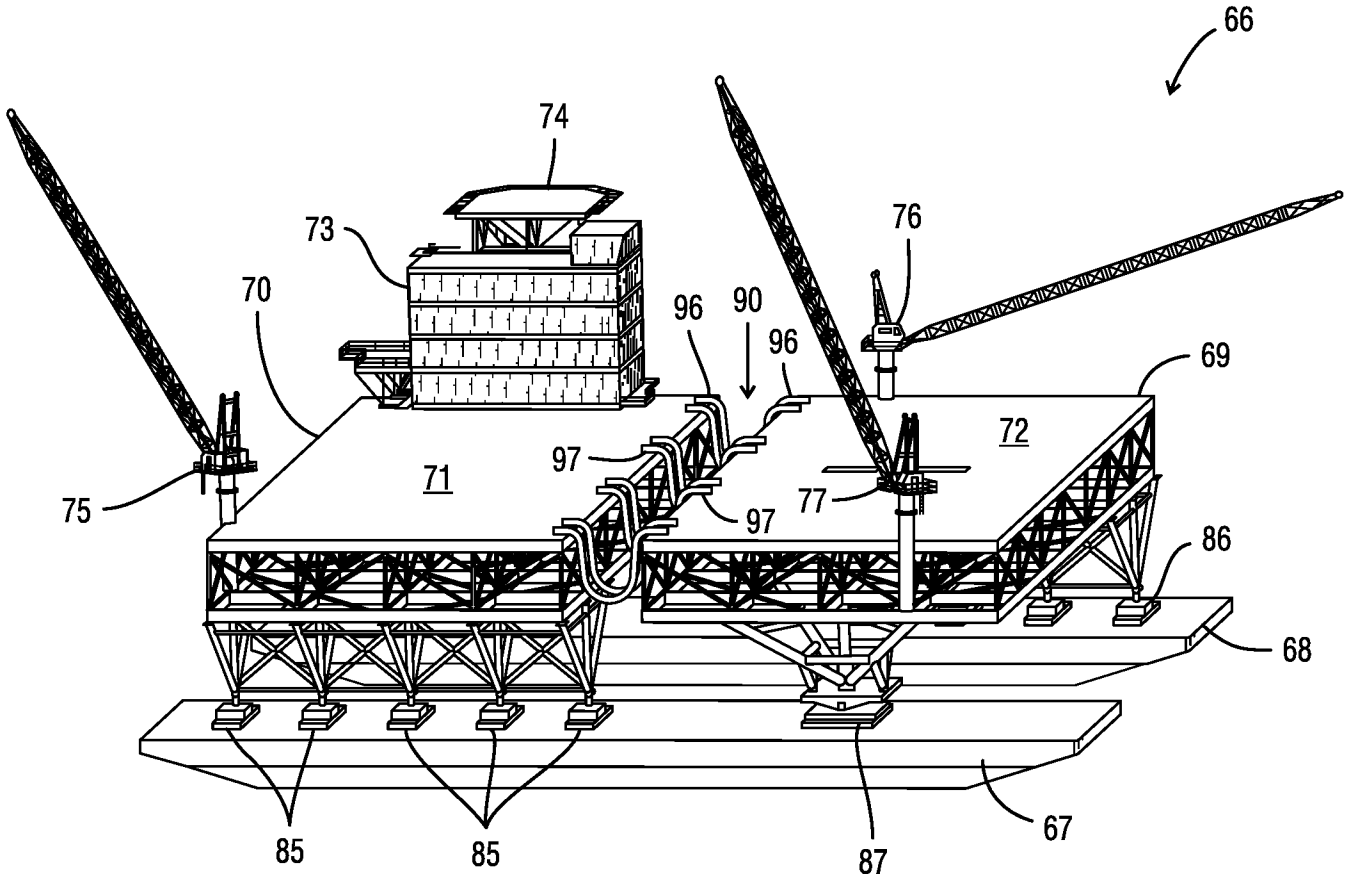
FIGS. 18-20 are perspective views of another embodiment of the apparatus of the present invention showing flexible hoses connecting production equipment located on two separate gantries.
Figure 19:
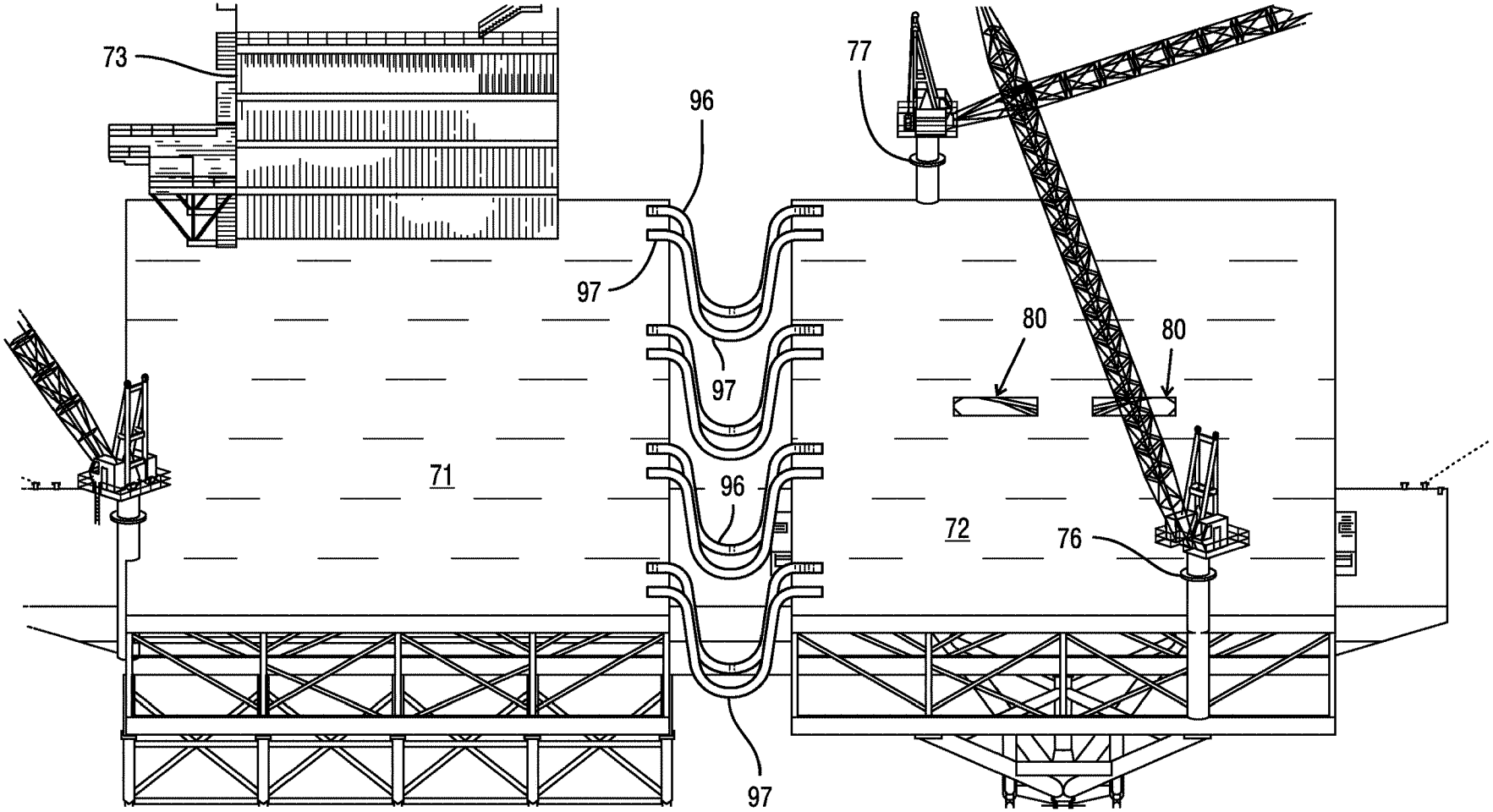
Figure 20:
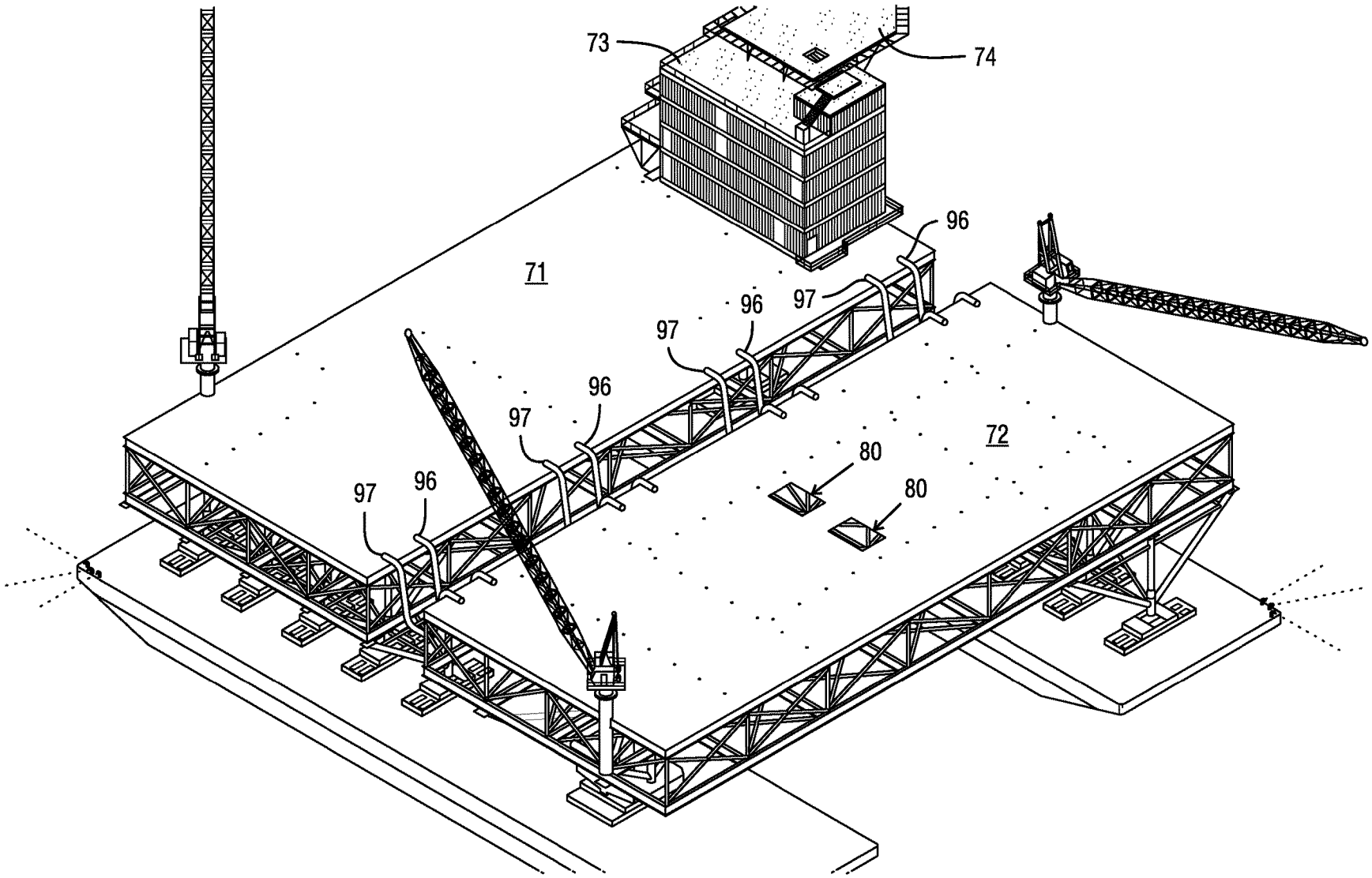

Each gantry or frame 69, 70 can have two wide sides (i.e., no pin-to-pin in either gantry), which locks the gantries 69, 70 rigidly to the barges 67, 68 in pitch motions but prevents any relative motions between the gantries. This arrangement allows for piping or hoses 96, 97 to be easily run between two gantries 69, 70. In this embodiment there can be more than two (2) gantries. FIGS. 18-20 are perspective views of another embodiment of the apparatus of the present invention showing flexible hoses 96. 97 connecting production equipment located on two separate gantries 69, 70.

In the case where there is a combination of pinned connection universal joints, there is relative motion between the gantries 69, 70. In such a case, flexible high pressure hoses 96, 97 can be preferably used to connect oil and gas production and compression equipment located on the two gantries 69, 70.

Figure 21:
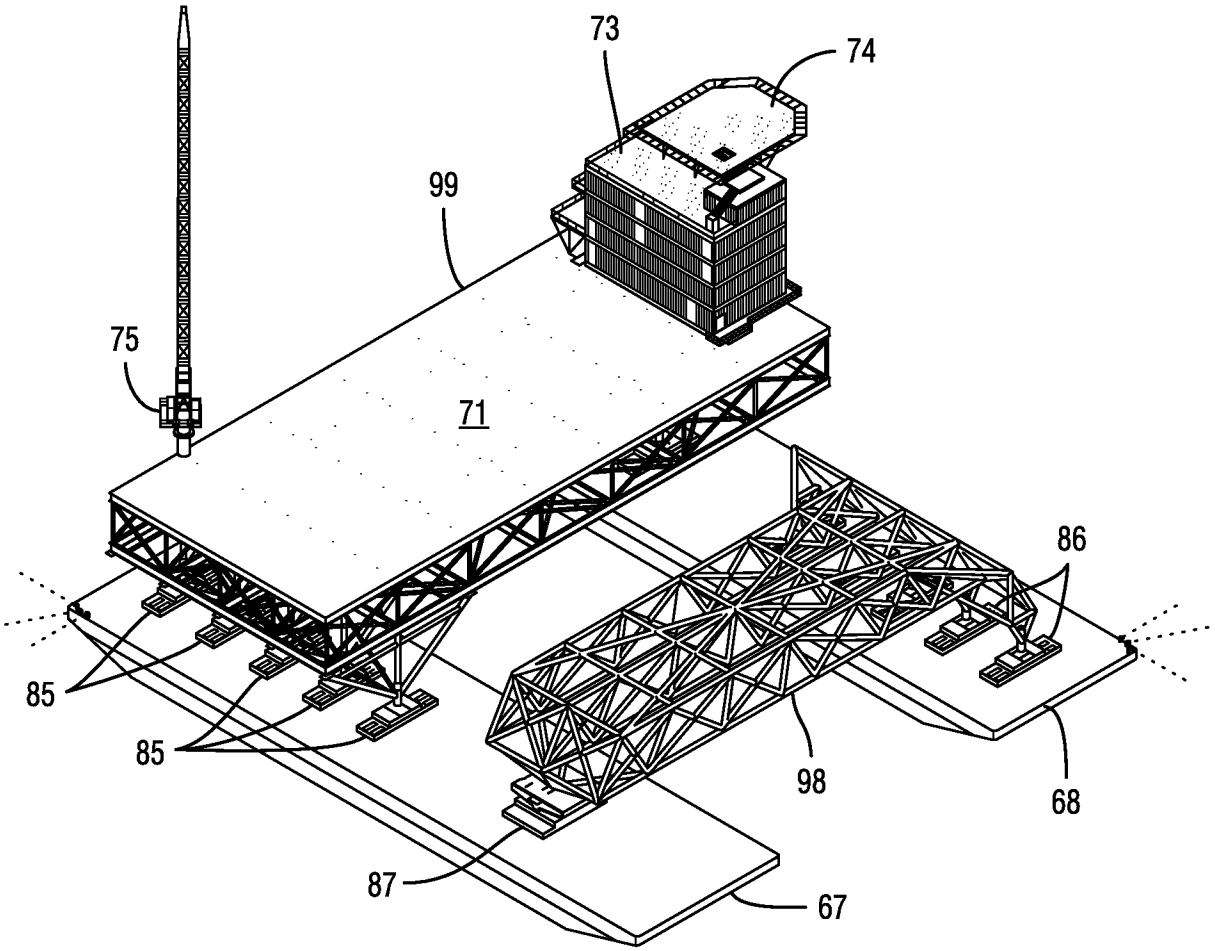
FIGS. 21-23 are perspective views of another embodiment of the apparatus of the present invention showing a single large gantry that preferably supports all of the production equipment, accommodations and risers, and a second structural-only gantry to provide structural continuity.
Figure 22:
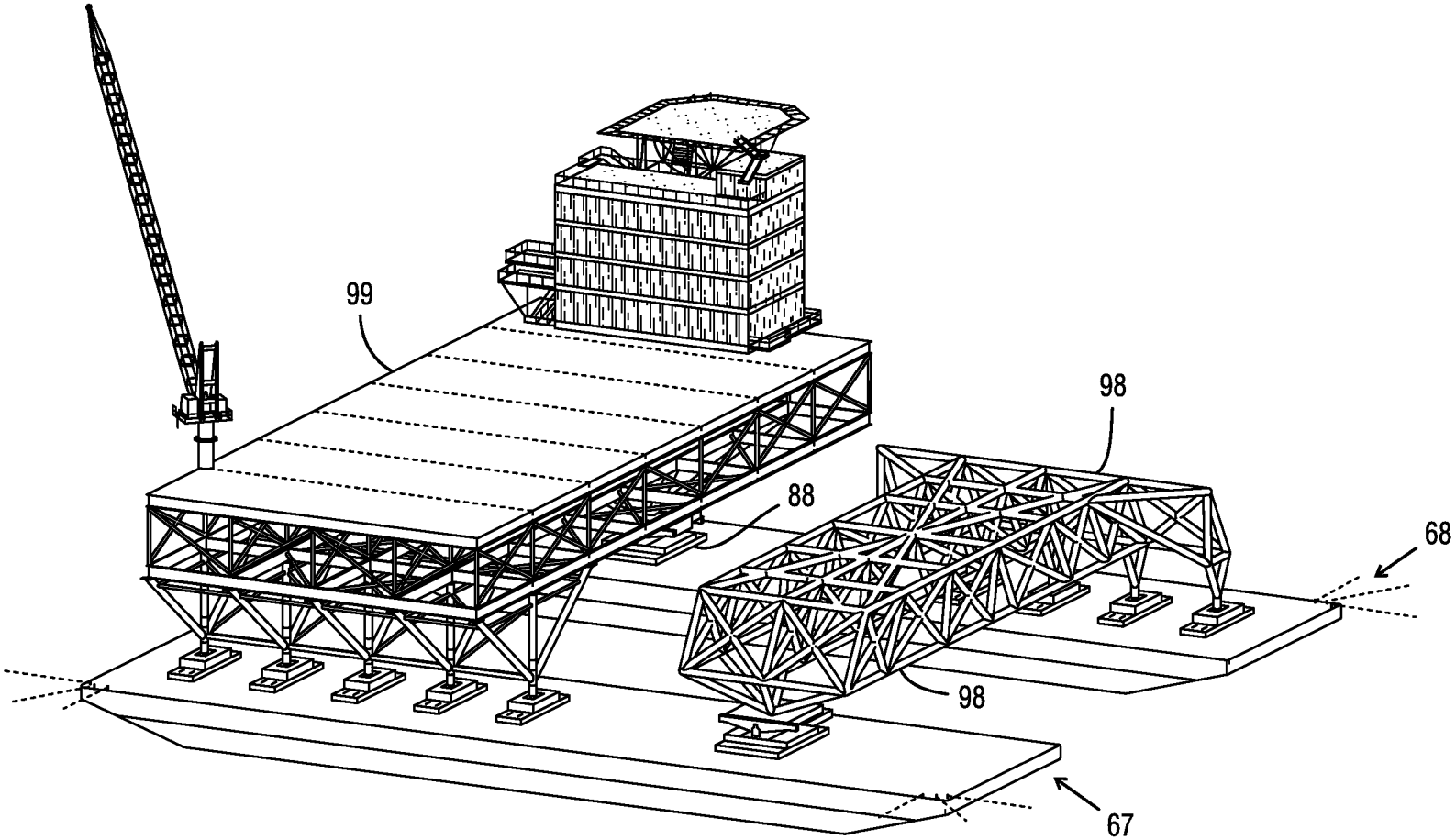
Figure 23:
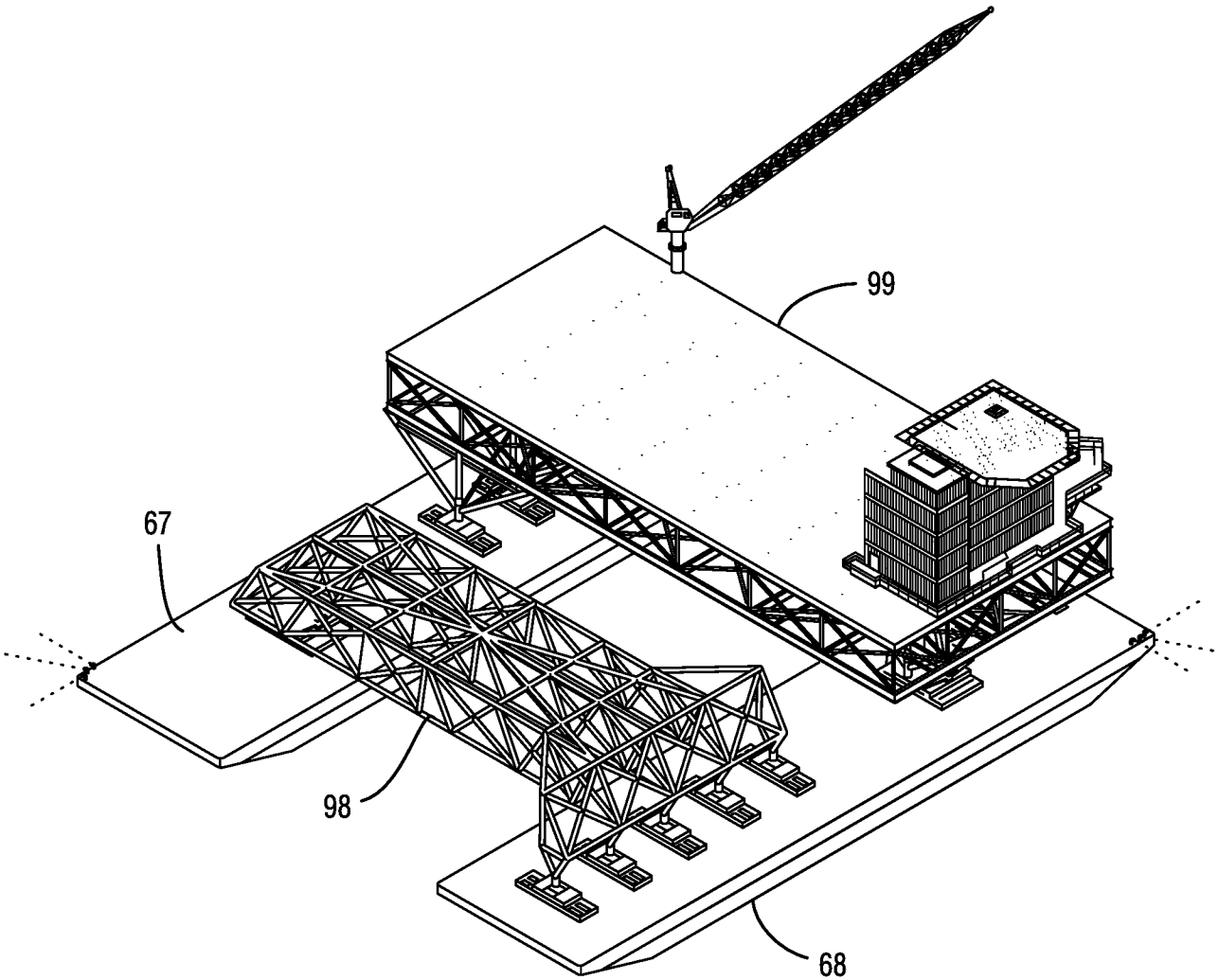

FIGS. 21-23 are perspective views of another embodiment of the apparatus of the present invention showing a single large gantry 98 that preferably supports all of the production equipment, accommodations and risers, and a second structural-only gantry 99 to provide structural continuity.

The following is a list of parts and materials suitable for use in the present invention.

PARTS LIST

| Part Number | Description |
|---|---|
| 10 | marine housing apparatus/quarterboat/personnel housing/platform |
| 11 | barge/vessel/hull/dynamically positioned vessel |
| 12 | barge/vessel/hull/dynamically positioned vessel |
| 13 | frame/forward frame |
| 14 | frame/aft frame |
| 15 | hinge/pivot/pivotal connection |
| 16 | universal joint connection |
| 17 | hinge/pivot/pivotal connection |
| 18 | universal joint connection |
| 19 | deck beam/interface |
| 20 | deck beam/interface |
| 21 | deck |
| 22 | deck |
| 23 | load spreader platform |
| 24 | load spreader platform |
| 25 | load spreader platform |
| 26 | load spreader platform |
| 27 | pilot house/cabin |
| 28 | bow |
| 29 | stern |
| 30 | personnel housing/crew quarters/building/hotel |
| 31 | pilot house/cabin |
| 32 | bow |
| 33 | stern |
| 34 | second housing/crew quarters |
| 35 | aft crew quarters/personnel housing |
| 36 | crane |
| 37 | post |
| 38 | pivotal connection |
| 39 | cabin |
| 40 | boom |
| 41 | bearing |
| 42 | support |
| 43 | post |
| 44 | boom bearing support post |
| 45 | truss |
| 50 | longitudinal, horizontal members |
| 51 | longitudinal, horizontal members |
| 52 | longitudinal, horizontal members |
| 53 | longitudinal, horizontal members |
| 54 | vertical member |
| 55 | diagonal member |
| 56 | post |
| 57 | post |
| 58 | cross bracing |
| 59 | transverse horizontal member, upper |
| 60 | transverse horizontal member, lower |
| 61 | horizontal beam |
| 62 | diagonal support/beam |
| 63 | cross bracing |
| 64 | pivot/pivotal connection |
| 65 | pivot/pivotal connection |
| 66 | oil production apparatus/catamaran floating oil production apparatus/drilling apparatus |
| 67 | vessel hull/dynamically positioned vessel/barge |
| 68 | vessel hull/dynamically positioned vessel/barge |
| 69 | frame |
| 70 | frame |
| 71 | oil production platform/drilling platform |
| 72 | oil production platform/drilling platform |
| 73 | crew quarters/building |
| 74 | heliport |
| 75 | crane |
| 76 | crane |
| 77 | crane |
| 78 | deck |
| 79 | deck |
| 80 | deck opening |
| 81 | riser pipe |
| 82 | tanker |
| 83 | spool |
| 84 | flow line/hose/conduit/hose connection |

-continued

PARTS LIST

| Part Number | Description |
|---|---|
| 85 | hinge/pivot/pivotal connection |
| 86 | hinge/pivot/pivotal connection |
| 87 | universal joint connection |
| 88 | universal joint connection |
| 89 | sea surface/water surface |
| 90 | space |
| 91 | oil production apparatus |
| 92 | arch shaped frame |
| 93 | lower end portion |
| 94 | lower end portion |
| 95 | oil production apparatus/catamaran floating oil production apparatus/drilling apparatus |
| 96 | piping or hoses |
| 97 | piping or hoses |
| 98 | gantry/large gantry |
| 99 | gantry/structural-only gantry |
| 100 | vessel |
| 110 | vessel |
| 115 | frame |
| 400 | overall DP Controller computer |
| 410 | structurally integrated and combined vessel/system |
| 420 | bridge controller computer |
| 500 | DP controlled thruster |
| 502 | position referencing system |
| 504 | DP controller |
| 506 | engine |
| 507 | rudder steerage |
| 508 | vessel bridge controller |
| 510 | DP controlled thruster |
| 512 | position referencing system |
| 514 | DP controller |
| 516 | engine |
| 517 | rudder steerage |
| 518 | vessel bridge controller |
| 520 | DP controlled thruster |
| 522 | position referencing system |
| 524 | DP controller |
| 526 | engine |
| 527 | rudder steerage |
| 528 | vessel bridge controller |
| 530 | DP controlled thruster |
| 532 | position referencing system |
| 534 | DP controller |
| 536 | engine |
| 537 | rudder steerage |
| 538 | vessel bridge controller |
| 600 | DP controlled thruster |
| 602 | position referencing system |
| 604 | DP controller |
| 606 | engine |
| 607 | rudder steerage |
| 608 | vessel bridge controller |
| 610 | DP controlled thruster |
| 612 | position referencing system |
| 614 | DP controller |
| 616 | engine |
| 617 | rudder steerage |
| 618 | vessel bridge controller |
| 620 | DP controlled thruster |
| 622 | position referencing system |
| 624 | DP controller |
| 626 | engine |
| 627 | rudder steerage |
| 628 | vessel bridge controller |
| 630 | DP controlled thruster |
| 632 | position referencing system |
| 634 | DP controller |
| 636 | engine |
| 637 | rudder steerage |
| 638 | vessel bridge controller |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A floating oil production apparatus comprising:

a) first and second vessels, each said vessel having a vessel deck that is elevated above a surrounding water surface;

b) a first frame spanning between the vessels;

c) a second frame spanning between the vessels;

d) wherein each of the frames includes a truss having first and second end portions;

e) the frames spaced apart and connecting to the vessels in a configuration that spaces the vessels apart;

f) each of the frames connected to each of the vessel decks with hinged connections;

g) an oil production platform supported on only one of said frames;

h) one or more risers that extend between a seabed and the production platform.

2. The apparatus of claim 1 wherein one or both vessels has at least one dynamic positioning function.

3. The apparatus of claim 2 wherein one or both of the vessels has a pilot house and the dynamic positioning functions of each vessel are controlled from a single said pilot house.

4. The apparatus of claim 1 wherein the truss has a lower portion elevated above the vessel decks and an upper portion spaced above said lower portion.

5. The apparatus of claim 4 wherein the oil production platform rests upon said upper portion of the truss.

6. The apparatus of claim 1 wherein the hinged connection includes multiple spaced apart pinned connections.

7. The apparatus of claim 1 wherein each frame extends a distance that is greater than the spacing between said vessels.

8. The apparatus of claim 4 wherein each frame upper portion occupies a plane.

9. The apparatus of claim 2 wherein the dynamic positioning functions of at least one vessel include thruster functions, steering functions and propulsion functions.

10. The apparatus of claim 2 wherein the dynamic positioning functions of both vessels include thruster functions, steering functions and propulsion functions.

11. The apparatus of claim 1 further comprising multiple load spreader platforms attached to deck portions of the vessels and wherein the first and second frames are each mounted on the load spreader platforms.

12. The apparatus of claim 1 wherein each vessel is a work boat having a bow portion with a pilot house, a deck portion behind the pilot house, one or more load spreader platforms attached to the deck portion and wherein the first and second frames are mounted on the one or more load spreader platforms.

13. The apparatus of claim 1 wherein each said frame supports a said oil production platform.

14. A method of supporting personnel housing in a marine environment, comprising the steps of:

a) providing first and second vessels;

b) spanning a first frame between the first and second vessels;

c) spanning a second frame between the first and second vessels;

d) connecting the first and second frames to the vessels in a configuration that spaces the first and second vessels apart;

e) connecting each said frame to each said vessel with hinged connections; and f) supporting a crew quarters building on only a first of said frames so that movement of the crew quarters is generated only by movement of the first frame.

15. The method of claim 14 wherein there is a second crew quarters building on a second of said frames.

16. The method of claim 14 wherein the crew quarters building is on the most forward of the frames.

17. The method of claim 14 wherein the crew quarters building is on the most aft of the frames.

18. The method of claim 14 further comprising the step of controlling each vessel's positioning with an electronic positioning device.

* * * * *